US010850188B2

(12) United States Patent
Takebayashi

(10) Patent No.: US 10,850,188 B2
(45) Date of Patent: Dec. 1, 2020

(54) WISDOM RING PUZZLE

(71) Applicant: i Subaru Co., Ltd., Joetsu (JP)

(72) Inventor: Koji Takebayashi, Joetsu (JP)

(73) Assignee: i Subaru Co., Ltd., Joetsu (JP)

( * ) Notice: Subject to any disclaimer, the term of this patent is extended or adjusted under 35 U.S.C. 154(b) by 0 days.

(21) Appl. No.: 16/851,583

(22) Filed: Apr. 17, 2020

(65) Prior Publication Data

US 2020/0330854 A1 Oct. 22, 2020

(30) Foreign Application Priority Data

Apr. 17, 2019 (JP) ..... 2019-078518

(51) Int. Cl.
*A63F 9/08* (2006.01)

(52) U.S. Cl.
CPC ..... *A63F 9/0876* (2013.01)

(58) Field of Classification Search
CPC ..... A63F 9/0876
USPC ..... D21/482; 273/159
See application file for complete search history.

(56) References Cited

U.S. PATENT DOCUMENTS 1,133,061 A * 3/1915 Quarles ..... A63F 9/0876 273/158
4,000,901 A * 1/1977 Flores ..... A63F 9/0876 273/158
4,907,805 A * 3/1990 Watkins ..... A63F 9/0876 273/158
4,957,292 A 9/1990 Ushiyama
D339,178 S * 9/1993 Saito ..... D21/482
2020/0246685 A1* 8/2020 Takebayashi ..... A63F 9/0876

FOREIGN PATENT DOCUMENTS

DE 9318115 U1 * 2/1994 ..... A63F 9/0876
DE 29605244 U1 * 5/1996 ..... A63F 9/0876
JP H2-283392 A 11/1990
JP 6112956 B2 3/2017
JP 2019084331 A * 6/2019
WO WO-2019087862 A1 * 5/2019 ..... A63F 9/08

OTHER PUBLICATIONS

"Colonial Classics Wire Wood Base—Locked Heart, Wood base NEW",«https://www.puzzlesandgames.com/au/mind-teasers/colonial-classics/colonial-classics-wire-wood-base-locked-heart-wood-base-new.html», retrieved on Jun. 26, 2020 (Year: 2020).*
"Colonial Classics Wire Wood Base—Spring and Shuttle", «https://www.puzzlesandgames.com.au/mind-teasers/colonial-classics-wire-wood-base-spring-and-shuttle-new.html», retrieved on Jun. 26, 2020. (Year: 2020).*

* cited by examiner

*Primary Examiner* — Steven B Wong
(74) *Attorney, Agent, or Firm* — Hauptman Ham, LLP

(57) ABSTRACT

A wisdom ring puzzle includes a base, a three-dimensional structure including a columnar structure and a first structure having an arched structure or an annular structure, and a member having an annular structure. The columnar structure has a first connection member and a first annular member. The columnar structure and the first structure are provided to face each other in a side view. The first connection member passes through the first structure and has one end connected to the columnar structure and another end to the first annular member. The columnar structure and the first structure is included inside a ring of the first annular member.

5 Claims, 33 Drawing Sheets

WISDOM RING PUZZLE

CROSS REFERENCE TO RELATED APPLICATIONS

This application is based upon and claims the benefit of priority from the prior Japanese Patent Application 2019-078518, filed on Apr. 17, 2019, the entire contents of which are incorporated herein by reference.

FIELD

The present invention relates to a wisdom ring puzzle having a three-dimensional structure and using a ring-shaped string.

BACKGROUND

Conventionally, as typified by a Chinese ring, a disentanglement puzzle configured of a plurality of posts each formed of a rod with a closed ring at one end and a closed ring-shaped string has been known. Also in recent years, by taking a Chinese ring as a prototype, a disentanglement puzzle has been suggested in which a closed ring made of a rigid material and a rod made of a rigid material having one end connected to this ring are taken as one post, the disentanglement puzzle including a plurality of said posts each having the rod of any other post passing through the inner side of the ring of each post and each having the other end of the rod mutually connected to the other ends, and a closed ring-shaped string made of a soft material, in which disentanglement is performed by removing the string hung on the rod of any post (Japanese Patent No. 6112956). Also, as a toy similar to the Chinese ring, a ring-moving toy has been known in which a ring fitting in one post is moved as fitting in the other post (Japanese Unexamined Patent Application Publication No. H02-283392).

SUMMARY

A wisdom ring puzzle according to one embodiment of the present invention includes a base, a three-dimensional structure including a columnar structure and a first structure having an arched structure or an annular structure, and a member having an annular structure, wherein the columnar structure has a first connection member and a first annular member, the columnar structure and the first structure are provided to face each other in a side view, the first connection member passes through the first structure and has one end connected to the columnar structure and another end to the first annular member, and the columnar structure and the first structure is provided inside a ring of the first annular member.

The wisdom ring puzzle according to another embodiment of the present invention may further include a second structure having an arched structure or an annular structure, a second connection member, and a second annular member, wherein the columnar structure may have the second connection member and the second annular member, the second connection member may pass through the second structure and may have one end connected to the columnar structure and another end connected to the second annular member, the columnar structure and the second structure may be provided inside a ring of the second annular member, and the second connection member may have a height from the base lower than a height of the first connection member from the base.

The first annular member may be swingably provided to the other end of the first connection member.

The second annular member may be swingably provided to the other end of the second connection member.

The first structure or the second structure may be an arched structure provided by bending one member or an oval structure including an oval member.

The first annular member may have a chain-link ring configured of two or more connection annular members, one of the connection annular members may be provided to the other end of the first connection member, the first structure may be provided inside a ring of one of the connection annular members, and the columnar structure may be provided inside a ring of another one of the connection annular members.

The second annular member may have a chain-link ring configured of two or more connection annular members, one of the connection annular members may be provided to the other end of the second connection member, the second structure may be provided inside a ring of one of the connection annular members, and the columnar structure may be provided inside a ring of another one of the connection annular members.

DESCRIPTION OF EMBODIMENTS

Figure 1A:
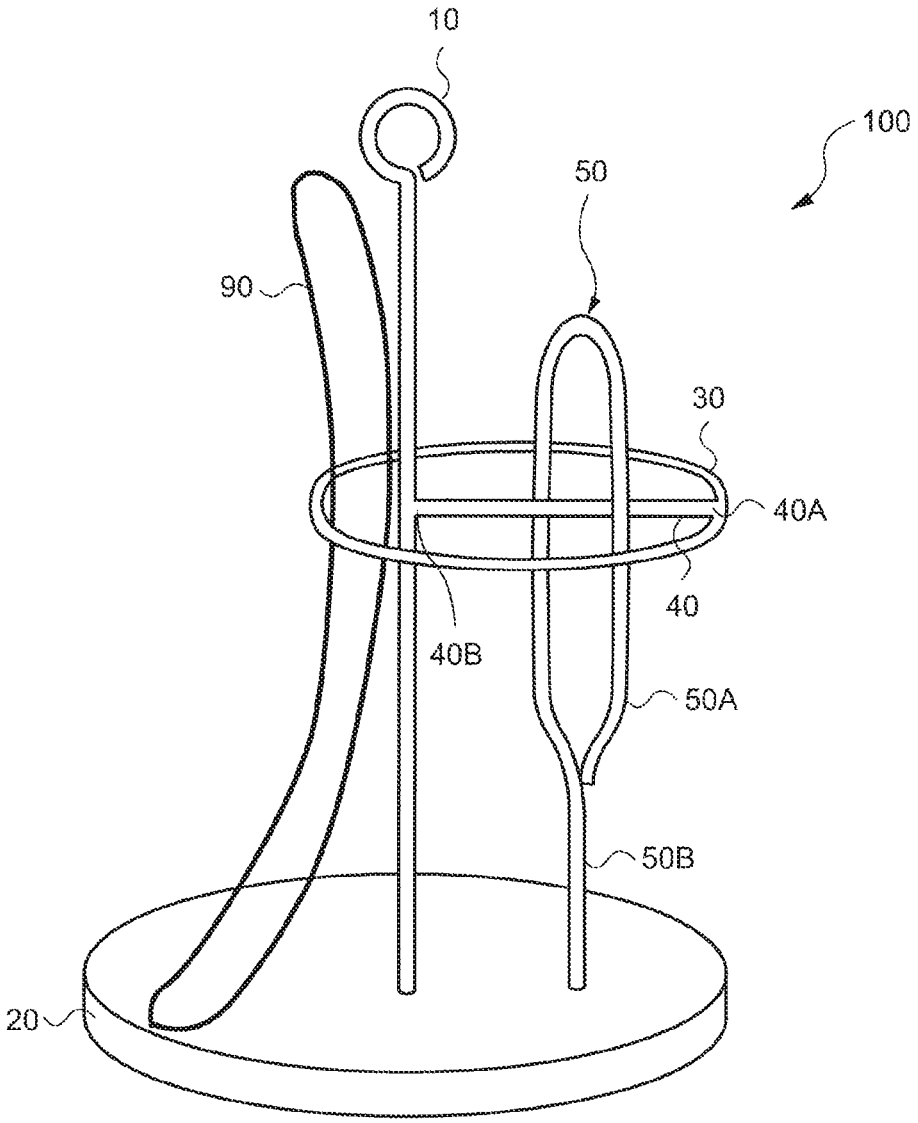
FIG. 1A is a diagram describing the structure of a wisdom ring puzzle in a first embodiment of the present invention.

In the following, embodiments of the present invention are described with reference to the drawings and so forth. The invention can be implemented in many different modes, and is not construed as being limited to description details of the embodiments exemplarily described below. Also, the drawings, for the purpose of further clarifying the description, the width, thickness, shape, and others of each part may be schematically represented compared with actual modes. However, this is merely an example, and is not meant to construe the present invention in a limited manner. Furthermore, in the specification and each drawing, a component similar to one described in relation to an already-described drawing is provided with the same reference character or an alphabet such as A or B and detailed description may be omitted as appropriate. A character "first" or "second" annexed to a component is an index for convenience to be used to distinguish each component and does not mean more unless otherwise specified.

In the specification and a drawing, "left" or "left side" means "left" or "left side" with respect to the sheet of the drawing, and "right" or "right side" means "right" or "right side" with respect to the sheet of the drawing. Also, "above" or "upper side" means "above" or "upper side" with respect to the sheet of the drawing, and "below" or "lower side" means "below" or "lower side" with respect to the sheet of the drawing. Therefore, it is evident that by freely changing a direction in which an object shown in the drawing is viewed, the relation among above, below, left, right, and so forth is freely changed in accordance with the direction in which an object is viewed, and this does not make the present invention construed in a limited manner.

The conventional disentanglement puzzle configured of a member having coupled rings and an elongated ring member or the conventional ring-moving toy in which a ring fitting in one post is moved as fitting in the other post, their solution is burdensome and can also be a repetition of simple mechanical operations. Thus, it is difficult to continuously providing interest and enthusiasm for solving the disentanglement puzzle or the ring-moving toy. Therefore, this disentanglement puzzle or ring-moving toy is not generally widespread.

The present invention is to provide a wisdom ring puzzle capable of continuously providing interest and enthusiasm.

1. First Embodiment

1-1. Structure of Wisdom Ring Puzzle 100

FIG. 1A is a diagram describing the structure of a wisdom ring puzzle 100 in a first embodiment of the present invention. In the wisdom ring puzzle 100 in the first embodiment of the present invention, an annular string 90 (member having an annular structure) having an appropriate length is put into or put out from a first structure 50 provided so as to face (be parallel to) a first annular member 30 and a post 10 connected to tips of a first connection member 40. Also, the wisdom ring puzzle 100 in the first embodiment of the present invention can be enjoyed by entwining the string 90 at the bottom (base bottom) of the post 10 (columnar structure) or removing the string 90 entwined at the bottom of the post 10. In the specification, entwining the string 90 around the wisdom ring puzzle 100 is referred to as an operation on the wisdom ring puzzle 100, and removing the string 90 entwined around the wisdom ring puzzle 100 is referred to as a solution of the wisdom ring puzzle 100.

The wisdom ring puzzle 100 has the post 10, a base 20, the first annular member 30, the first connection member 40, the first structure 50, and the string 90. As a material configuring the post 10, the base 20, the first annular member 30, the first connection member 40, and the first structure 50, a material not easily deformed is adopted, such as plastic, wood, or metal. As a material configuring the string 90, an easily-bendable material is used, such as a rubber-like member or a fibrous member. In the specification and so forth, for example, the material configuring the post 10, the base 20, the first annular member 30, the first connection member 40, and the first structure 50 is a metal and the material configuring the string 90 is a fibrous member.

The post 10 is provided substantially at the center of the base 20. For example, one end of the post 10 is inserted into a hole provided substantially at the center of the base 20.

The first structure 50 is provided on the base 20 so as to face the post 10. For example, the first structure 50 is inserted into a hole provided at a position on the base 20 where the first structure 50 faces the post 10. The first structure 50 has a hollow part. The hollow part may take a substantially circular shape, an oval shape, an elliptical shape, or a rectangular shape. The first structure 50 may have any annular shape allowing the string or the connection member to pass therethrough. Also, the first structure 50 may be an arched structure with one rod-shaped member bent in an arched shape. As shown in FIG. 1A, the first structure 50 is configured of, for example, a member with an annular structure 50A and a rod-shaped structure 50B connected together.

The first annular member 30 is an annular member. As shown in FIG. 1A, the first annular member 30 has, for example, a substantially circular shape. The first annular member 30 may have an oval shape, an elliptical shape, or a rectangular shape. The first annular member 30 can implement solutions of the wisdom ring puzzle described in the specification and so forth, and may have any annular shape.

The first connection member 40 passes through the annular structure 50A, and has one end 40A connected to the first annular member 30 and the other end 40B connected to the post 10. Since the first annular member 30 and the first connection member 40 are connected to the post 10, it can be said, in other words, that the post 10 has the first annular member 30 and the first connection member 40. Also, the post 10 and the first structure 50 are provided inside the ring of the first annular member 30.

The base 20 is provided to stably fix a three-dimensional structure having the post 10 and an arched structure or annular structure. The three-dimensional structure is the first structure 50, a second structure 80, which will be described further below, or the like. As shown in FIG. 1A, for example, the base 20 is made of a plate-shaped member having a circular shape, but is not limited to this example. The base 20 may have a quadrangular shape or a polygonal shape. The base 20 may have any structure capable of stably fixing the post 10 and the three-dimensional structure. The post 10 and the base 20 may be integrally formed. With the post 10 and the base 20 integrally formed, cost of manufacturing the wisdom ring puzzle can be reduced.

The post 10, the first structure 50, and the second structure 80 may be fixed or attachable to and detachable from the base 20. In one wisdom ring puzzle 100, when the post 10, the first structure 50, and the second structure 80 are attachable to and detachable from the base 20, a user can freely change a combination of the post 10, the first structure 50, and the second structure 80.

Therefore, the user can enjoy puzzles of various combinations.

1-2. First Operation of Wisdom Ring Puzzle 100

A first operation of the wisdom ring puzzle 100 in the first embodiment of the present invention is described by using FIG. 2A to FIG. 2E. Description of a structure identical or similar to that of FIG. 1A may be omitted.

Here, the first operation of entwining the string 90 at the bottom of the post 10 is described. In the specification and so forth, for description of operations and solutions of the wisdom ring puzzle 100, as shown in FIG. 1A, it is assumed that, with the string 90 first passing through the first annular member 30, the first connection member 40 and the first structure 50 are on a right side of the post 10. It is also assumed that a tip of the string 90 passes through the first annular member 30 along the post 10 from below to above and is then caused to go to a left side of the post 10. Furthermore, a space between the first structure 50 and the post 10 may be referred to as the inside of the first structure 50 and a space on a right side of the first structure 50 may be referred to as outside or a right-side space.

Figure 2A:
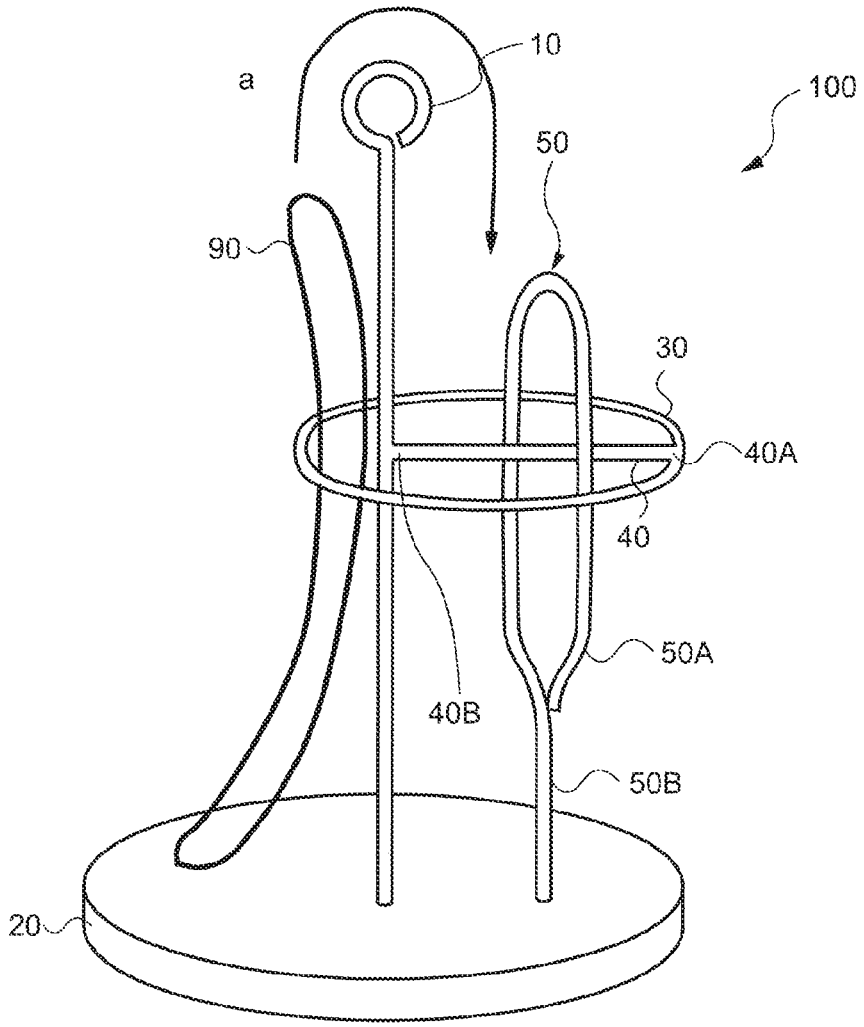
FIG. 2A is a diagram describing a first operation and a first solution of the wisdom ring puzzle 100 in the first embodiment of the present invention.

First, the state is such that the string 90 is removed from each member provided to the base 20. As shown in FIG. 2A, the tip of the string 90 is put from a left side of the post 10 and below the first annular member 30. Next, as indicated by an arrow a of FIG. 2A, the tip of the string 90 is caused to go over the post 10 to be positioned on a right side between the post 10 and the first annular member 30. A series of operation described by using FIG. 2A is referred to as step 201.

Figure 2B:
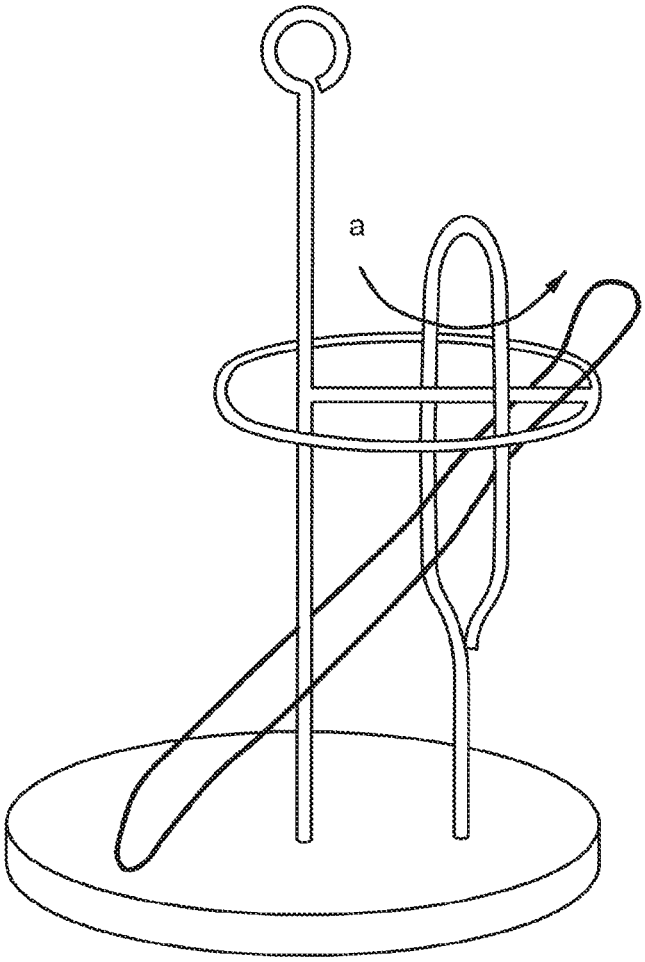
FIG. 2B is a diagram describing the first operation and the first solution of the wisdom ring puzzle 100 in the first embodiment of the present invention.

Subsequently, as indicated by an arrow a of FIG. 2B, the tip of the string 90 is moved to pass through the inside of the annular structure 50A to go along the first connection member 40 from the other end 40B to the one end 40A. Then, as shown in FIG. 2B the tip of the string 90 is caused to be positioned on the right side of the first structure 50 (step 202).

Figure 2C:
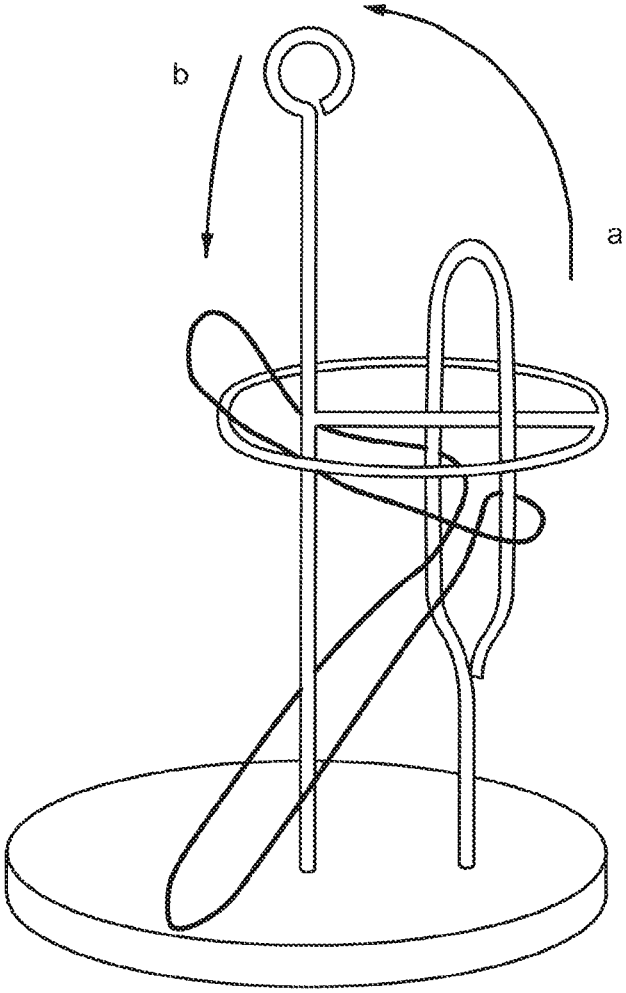
FIG. 2C is a diagram describing the first operation and the first solution of the wisdom ring puzzle 100 in the first embodiment of the present invention.

Next, as indicated by arrows a and b of FIG. 2C, the tip of the string 90 is caused to go from the right side of the first structure 50 over the first structure 50 and further over the post 10 to be positioned on a left side of the post 10 (step 203). Subsequently, as indicated by an arrow a of FIG. 2D, the tip of the string 90 is moved along the post 10 from above to below the first annular member 30 (step 204).

Figure 2D:
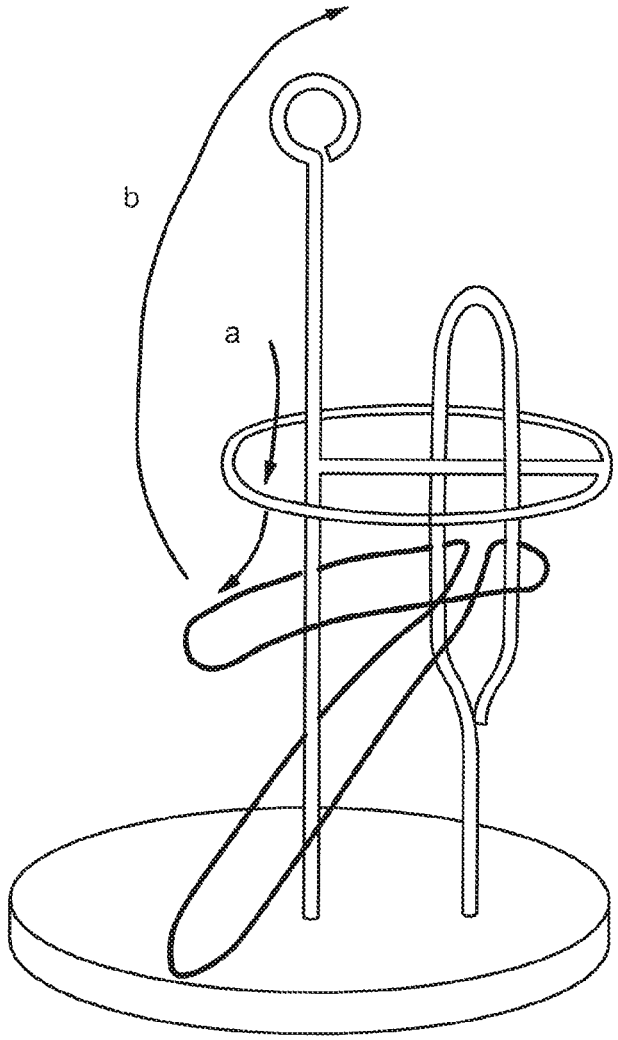
FIG. 2D is a diagram describing the first operation and the first solution of the wisdom ring puzzle 100 in the first embodiment of the present invention.
Figure 2E:
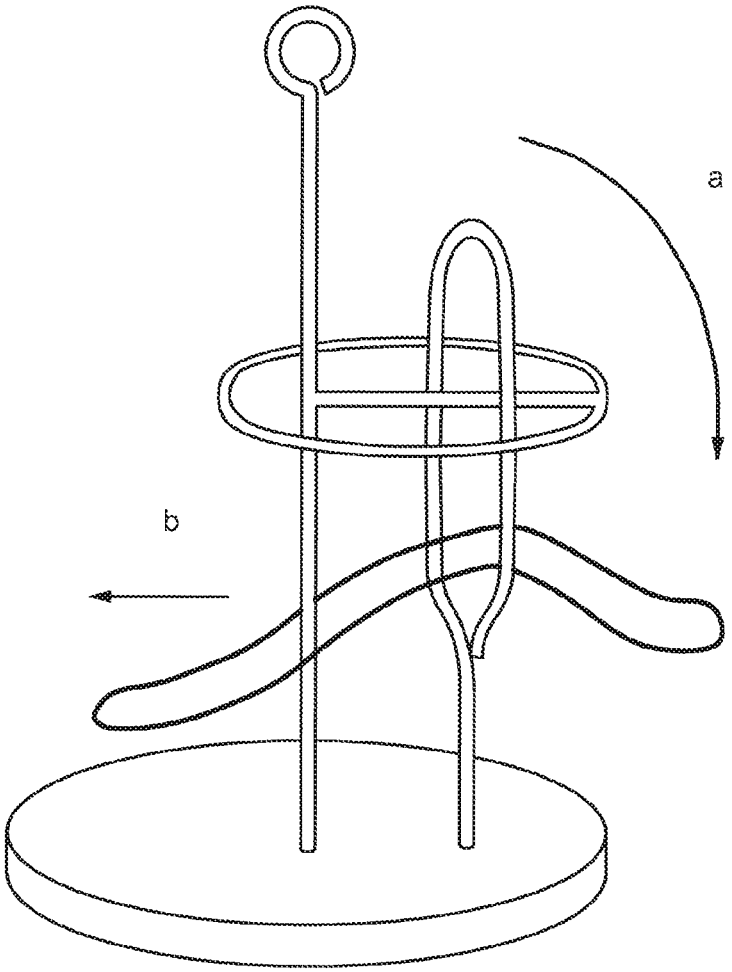
FIG. 2E is a diagram describing the first operation and the first solution of the wisdom ring puzzle 100 in the first embodiment of the present invention.

Furthermore, as indicated by an arrow b of FIG. 2D and an arrow a of FIG. 2E, the tip of the string 90 is moved so as to pass the left side of the first structure 50 to go over the post 10 and the first structure 50. Then, as shown in FIG. 2E, the string 90 is caused to be positioned in the right-side space of the first structure 50 (step 205). By the operation up to step 205, the string 90 entwined around the first structure 50 is moved from above to below the first connection member 40.

Lastly, as indicated by an arrow b of FIG. 2E, a tip opposite to the above-described tip of the string 90 is pulled to pass below the annular structure 50A. Then, the tip of the string 90 is caused to be entwined at the bottom of the post 10 (step 206).

1-3. First Solution of Wisdom Ring Puzzle 100

A first solution of the wisdom ring puzzle 100 in the first embodiment of the present invention is described.

In the first solution, the operations from step 201 to step 206 described by using FIG. 2A to FIG. 2E are performed in reverse from step 206 to step 201, thereby allowing the string entwined at the bottom of the post 10 to be removed from the post 10. In the following, a brief description is given. The tip of the string 90 is moved to pass below the first connection member 40 through a lower part of the annular structure 50A of the first structure 50. Then, the tip of the string 90 is caused to go over the first annular member 30 and the post 10 to be positioned on the left side of the post 10. Next, the tip of the string 90 is moved along the post 10 from below to above the left side of the first annular member 30. Then, the tip of the string 90 is caused to go over the post 10 and the first structure 50 to be positioned on the right side of the first structure 50 (on the one end 40A side of the first connection member 40). Furthermore, the tip of the string 90 is moved along the first connection member 40 from the one end 40A to the other end 40B to go over the post 10. This causes the string 90 to become in the state shown in FIG. 2A. By pulling the opposite side of the tip of the string 90, the string 90 can be removed from each member provided to the base 20.

1-4. Second Operation of Wisdom Ring Puzzle 100

A second operation of the wisdom ring puzzle 100 in the first embodiment of the present invention is described by using FIG. 3A to FIG. 3D. Description of a structure identical or similar to that of FIG. 1A and FIG. 2A to FIG. 2E may be omitted.

Figure 3A:
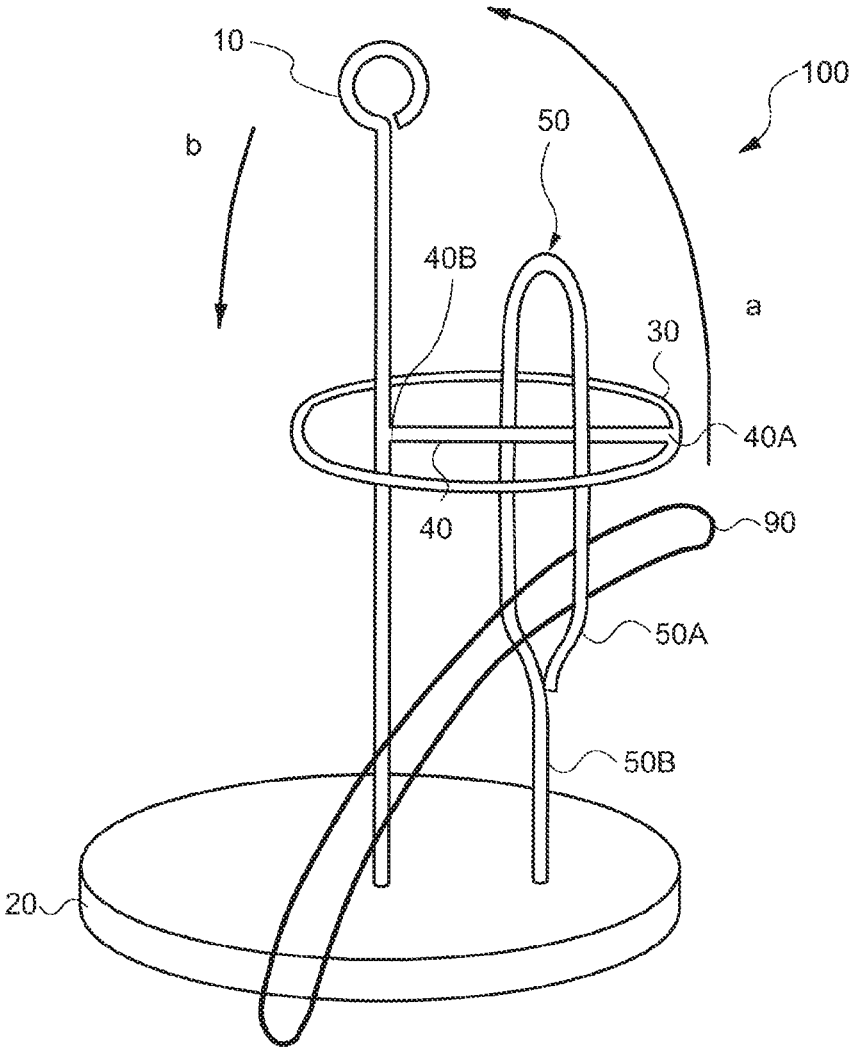
FIG. 3A is a diagram describing a second operation and a second solution of the wisdom ring puzzle 100 in the first embodiment of the present invention.

First, from the state in which the string 90 is removed from each member provided to the base 20, as shown in FIG. 3A, the tip of the string 90 is moved to pass below the first connection member 40 through the lower part of the annular structure 50A of the first structure 50 (step 301).

Figure 3B:
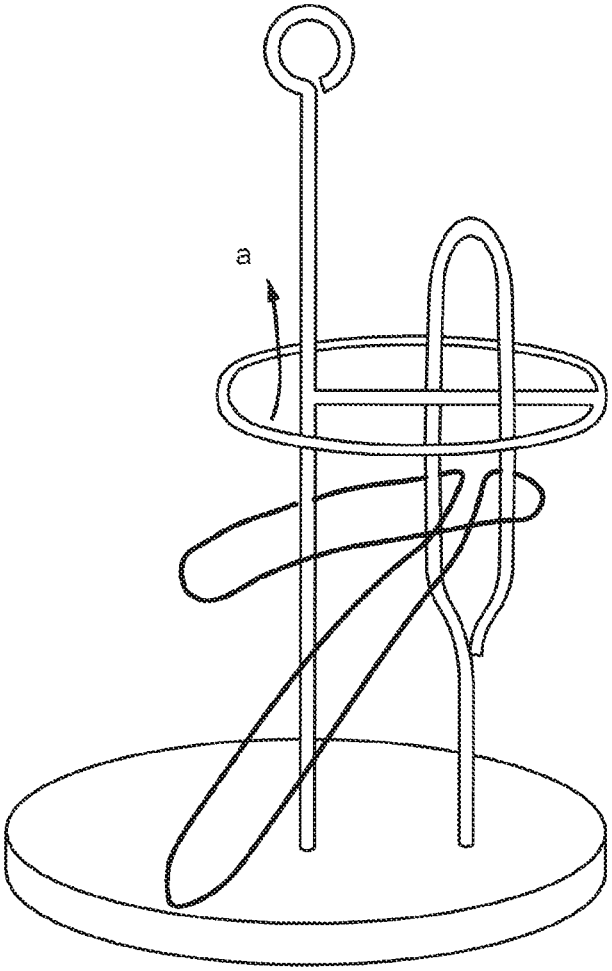
FIG. 3B is a diagram describing the second operation and the second solution of the wisdom ring puzzle 100 in the first embodiment of the present invention.
Figure 3C:
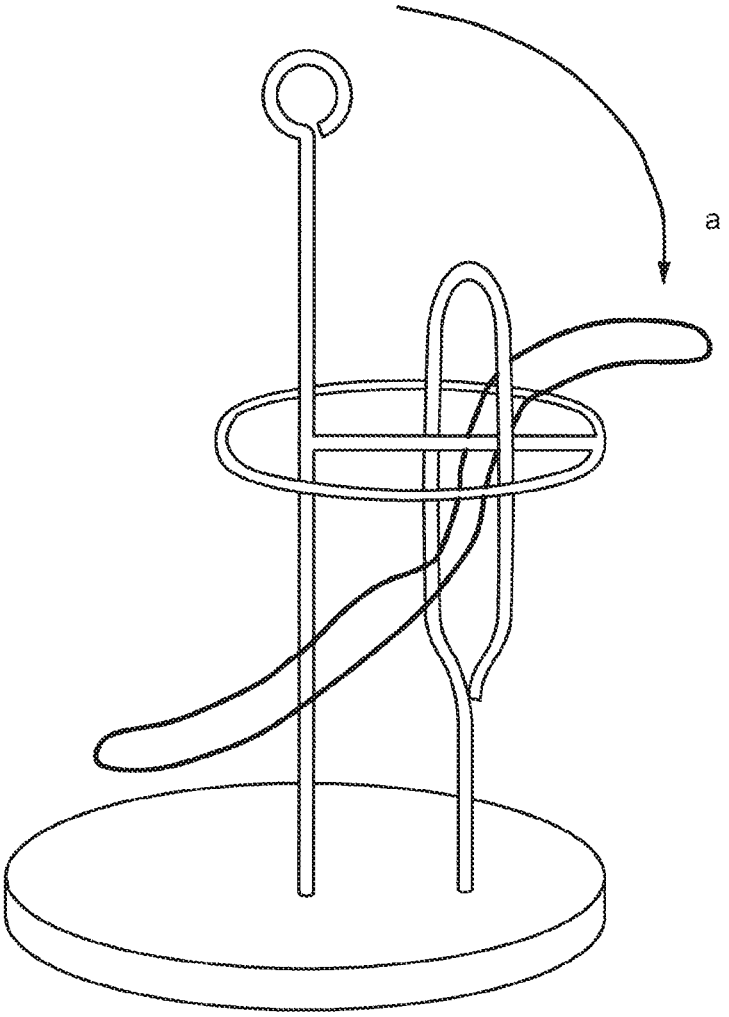
FIG. 3C is a diagram describing the second operation and the second solution of the wisdom ring puzzle 100 in the first embodiment of the present invention.

Subsequently, as indicated by arrows a and b of FIG. 3A, the tip of the string 90 is moved from the right side of the first structure 50 and the outside the first annular member 30 to go over the first annular member 30, the first structure 50, and the post 10 to the left side of the post 10 and the left side (outside) of the first annular member 30 to become a state shown in FIG. 3B (step 302).

Next, as indicated by an arrow a of FIG. 3B, the tip of the string 90 is moved along the post 10 from below to above the first annular member 30 (step 303). Furthermore, as indicated by an arrow a of FIG. 3C, the tip of the string 90 is caused to go over the post 10 and the first structure 50 to become a state of being positioned on the right side of the first structure 50 (step 304).

Figure 3D:
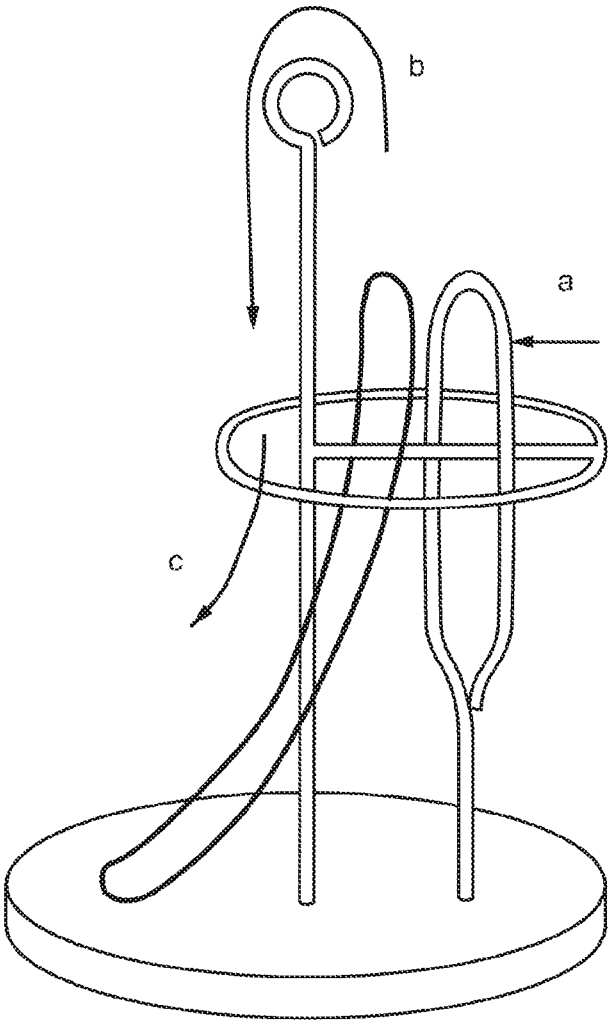
FIG. 3D is a diagram describing the second operation and the second solution of the wisdom ring puzzle 100 in the first embodiment of the present invention.

Subsequently, as indicated by an arrow a of FIG. 3D, the tip of the string 90 is moved to pass through the inside of the annular structure 50A to go along the first connection member 40 from the one end 40A to the other end 40B. Then, as shown in FIG. 3D, the tip of the string 90 is caused to be positioned between the post 10 and the first structure 50 (step 305).

Furthermore, as indicated by arrows b and c of FIG. 3D, from the state of being positioned between the post 10 and the first structure 50, the tip of the string 90 is moved to go over the post 10 to go along the post 10 from below to above the first annular member 30, thereby being entwined at the bottom of the post 10 (step 306).

1-5. Second Solution to Wisdom Ring Puzzle 100

A second solution of the wisdom ring puzzle 100 in the first embodiment of the present invention is described.

In the second solution, the operations from step 301 to step 306 described by using FIG. 3A to FIG. 3D are performed in reverse from step 306 to step 301, thereby allowing the string entwined at the bottom of the post 10 to be removed from the post 10. In the following, a brief description is given. The tip of the string 90 is moved from below to above the left side of the first annular member 30. Subsequently, the tip of the string 90 is caused to go over the post 10 to be positioned between the post 10 and the first structure 50. Next, the tip of the string 90 is moved along the first connection member 40 from the other end 40B to the one end 40A to be positioned on the right side of the first structure 50. Furthermore, the tip of the string 90 is moved to go over the first structure 50 and the post 10 to go along the post 10 from above to below the first annular member 30. Subsequently, the tip of the string 90 is caused to go over the post 10 and the first structure 50 from outside (left side of) the first annular member 30 to become in the state shown in FIG. 3A. By pulling the opposite side of the tip of the string 90, the string 90 can be removed from each member provided to the base 20.

1-6. Modification Example of Wisdom Ring Puzzle 100

In the specification and so forth, the first annular member 30 may be swingably provided to the one end 40A of the first connection member 40. For example, the first connection member 40 is formed of a wire, and the one end 40A of the first connection member 40 is formed to have a ring shape. With the first annular member 30 surrounded by the ring-shaped portion at the one end 40A of the first connection member 40 so as not be detachable, the first annular member 30 can be swingably provided to the one end 40A of the first connection member 40.

In the specification and so forth, the example is described in which the first annular member 30 includes the post 10 and the first structure 50 inside the ring of the first annular member 30. However, the present embodiment is not limited to this. The first annular member 30 may not include the post 10 inside the ring of the first annular member 30. For example, the first annular member 30 has a chain-link ring configured of two or more connected annular members. When the first annular member 30 has a chain-link ring, of two or more connected annular members configuring the chain-link ring, the post 10 is provided inside the ring of any one of the annular members, and the first structure 50 is provided inside the ring of any one of the annular members configuring the chain-link ring positioned oppositely to the post 10 (on a first structure 50 side) with respect to the annular member including the post 10. That is, the wisdom ring puzzle 100 can include a structure having an annular member not including the post 10 inside its ring.

In the specification and so forth, the example is described in which the first connection member 40 is connected to the post 10 as passing through the inside of the first structure 50. However, the present embodiment is not limited to this. The first connection member 40 may not pass through the inside of the first structure 50. For example, the first connection member 40 does not pass through the inside of the first structure 50 but is provided on a side of the post 10 opposite to the side where the first structure 50 is provided.

In the specification and so forth, a connection member A that is different from the first connection member 40 and an annular member A that is different from the first annular member 30 may be provided. For example, the connection member A may have one end connected to the annular member A and the other end connected to the post 10, and the connection member A may not pass through the inside of the first structure 50 but may be provided so as to include the first structure 50 inside. For example, the connection member A and the annular member A are provided on a side of the post 10 opposite to the side where the first connection member 40 is provided and at a position of the post 10 higher than the height of the first connection member 40 from the base 20. Alternatively, for example, the connection member A and the annular member A are provided on a side of the post 10 opposite to the side where the first connection member 40 is provided and at a position of the post 10 lower than the height of the first connection member 40 from the base 20.

As described above, since the wisdom ring puzzle 100 in the first embodiment of the present invention has a structure not in conventional disentanglement puzzles, operations and solutions different from those of the conventional disentanglement puzzles are necessary, and the user can continuously maintain interest and enthusiasm for the wisdom ring puzzle.

Also, since the wisdom ring puzzle 100 in the first embodiment of the present invention can have any of various structures as described above, operations and solutions different from those of the conventional disentanglement puzzles are necessary, and the user can continuously maintain interest and enthusiasm for the wisdom ring puzzle.

2. Second Embodiment

2-1. Structure of Wisdom Ring Puzzle 200

Figure 1B:
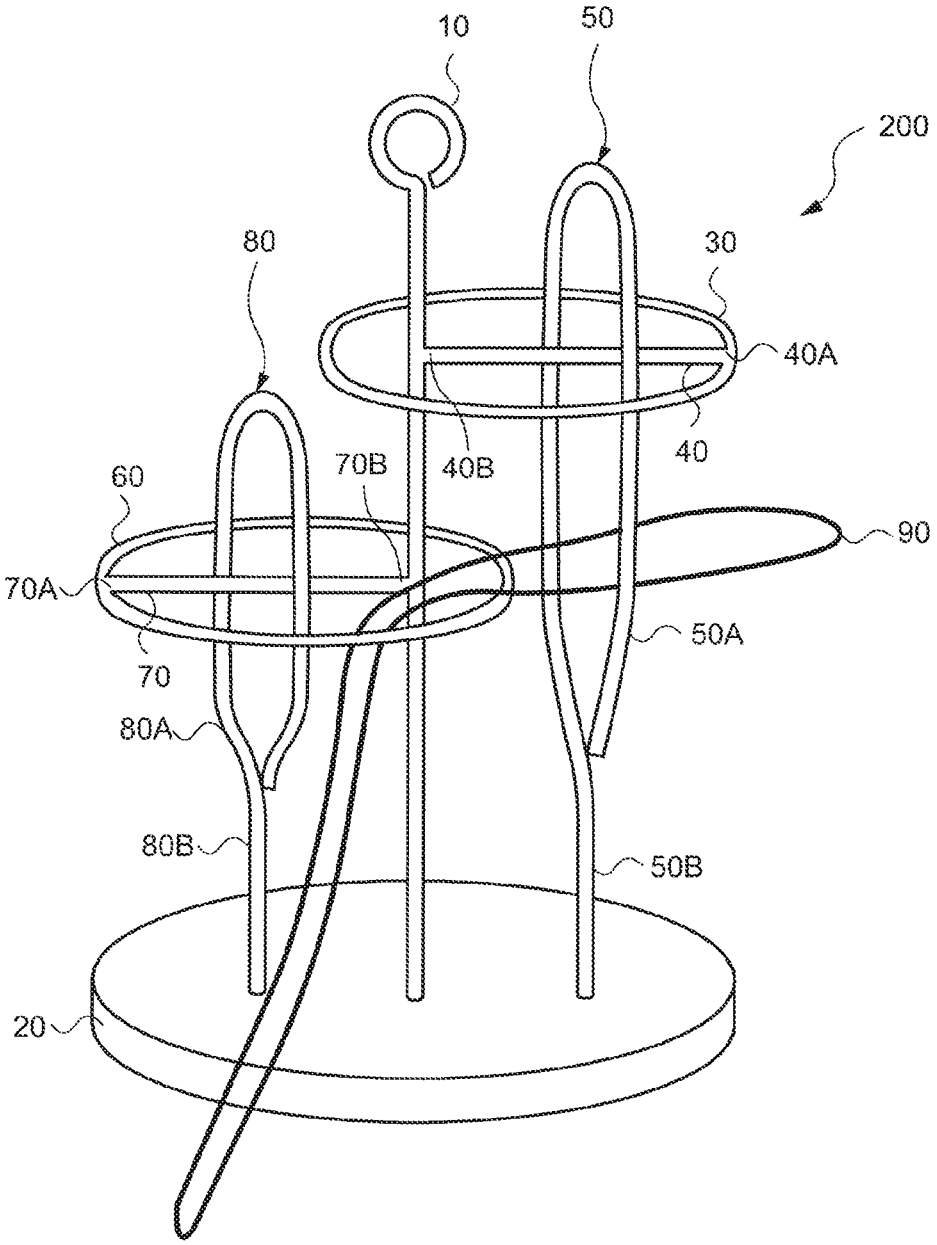
FIG. 1B is a diagram describing the structure of a wisdom ring puzzle in a second embodiment of the present invention.

FIG. 1B is a diagram describing the structure of a wisdom ring puzzle 200 in a second embodiment of the present invention. The wisdom ring puzzle 200 in a second embodiment of the present invention has a structure further including, in addition to the structure of the first embodiment, the second structure 80, a second connection member 70, and a second annular member 60. In the description of the wisdom ring puzzle 200 in the second embodiment of the present invention, description of a structure similar to the structure of the first embodiment is omitted, and the second structure 80, the second connection member 70, and the second annular member 60 are mainly described. Description of a structure identical or similar to that of FIG. 1A, FIG. 2A to FIG. 2E, and FIG. 3A to FIG. 3D may be omitted.

In the wisdom ring puzzle 200 in the second embodiment of the present invention, the annular string 90 having an appropriate length is put into or put out from the first structure 50 provided so as to face the first annular member 30 and the post 10 connected to the tips of the first connection member 40 and the second structure 80 provided so as to face the second annular member 60 connected to one tip 70A of the second connection member 70 and the post 10. Also, the wisdom ring puzzle 200 in the second embodiment of the present invention can be enjoyed by entwining the string 90 at the bottom of the post 10 or removing the string 90 entwined at the bottom of the post 10.

The second structure 80 is attachably and detachably provided on the base 20 so as to face the post 10. For example, as with the first structure 50, the second structure 80 is inserted into a hole provided at a position on the base 20 where the second structure 80 faces the post 10. The second structure 80 can take a structure and form similar to that of the first structure 50. As shown in FIG. 1B, the second structure 80 is configured of, for example, a member with an annular structure 80A and a rod-shaped structure 80B connected together.

The second annular member 60 is an annular member. As shown in FIG. 1B, the second annular member 60 has, for example, a substantially circular shape. The second annular member 60 can take a structure and form similar to that of the first annular member 30.

The second connection member 70 passes through the annular structure 80A, and has one end 70A connected to the second annular member 60 and the other end 70B connected to the post 10. Since the second annular member 60 and the second connection member 70 are connected to the post 10, it can be said, in other words, that the post 10 has the second annular member 60 and the second connection member 70. Also, the post 10 and the second structure 80 are provided inside the ring of the second annular member 60.

In the wisdom ring puzzle 200 in the second embodiment of the present invention, the height of the second connection member 70 from the base 20 is lower than the height of the first connection member 40 from the base 20. However, the present embodiment is not limited to this example. For example, in the wisdom ring puzzle 200 in the second embodiment of the present invention, the height of the second connection member 70 from the base 20 may be higher than the height of the first connection member 40 from the base 20. In the wisdom ring puzzle 200 in the second embodiment of the present invention, it is only required that the height of the second connection member 70 from the base 20 and the height of the first connection member 40 from the base 20 have a difference. By this difference, a space can be provided between the second annular member 60 and the first annular member 30, thereby allowing the string 90 to be moved smoothly.

2-2. First Operation of Wisdom Ring Puzzle 200

A first operation of the wisdom ring puzzle 200 in the second embodiment of the present invention is described by using FIG. 4A to FIG. 4I and FIG. 5A to FIG. 5D. Description of a structure identical or similar to that of FIG. 1A, FIG. 2A to FIG. 2E, and FIG. 3A to FIG. 3D may be omitted.

Here, the first operation of entwining the string 90 at the bottom of the post 10 is described. In the specification and so forth, for description of operations and solutions of the wisdom ring puzzle 200, as shown in FIG. 1B, it is assumed that the first connection member 40 and the first structure 50 are on the right side of the post 10 and the second connection member 70 and the second structure 80 are on the left side of the post 10. Also, a space between the post 10, and the first structure 50 and the second structure 80 may be referred to as an inner space, and a space around the first structure 50 and the second structure 80 may be referred to as outside. Furthermore, the outside may be referred to as a right-side space or left-side space.

First, from the state in which the string 90 is removed from each member provided to the base 20, as shown in FIG. 1B, the string 90 passes through the second annular member 60 from below to above. Subsequently, the string 90 passes through the annular structure 50A of the first structure 50 lower than the first connection member 40. Then, the tip of the string 90 is caused to be positioned on the right side of the first structure 50 and outside the first annular member 30, that is, on the right side and outside of the first structure 50 (step 401).

Figure 4A:
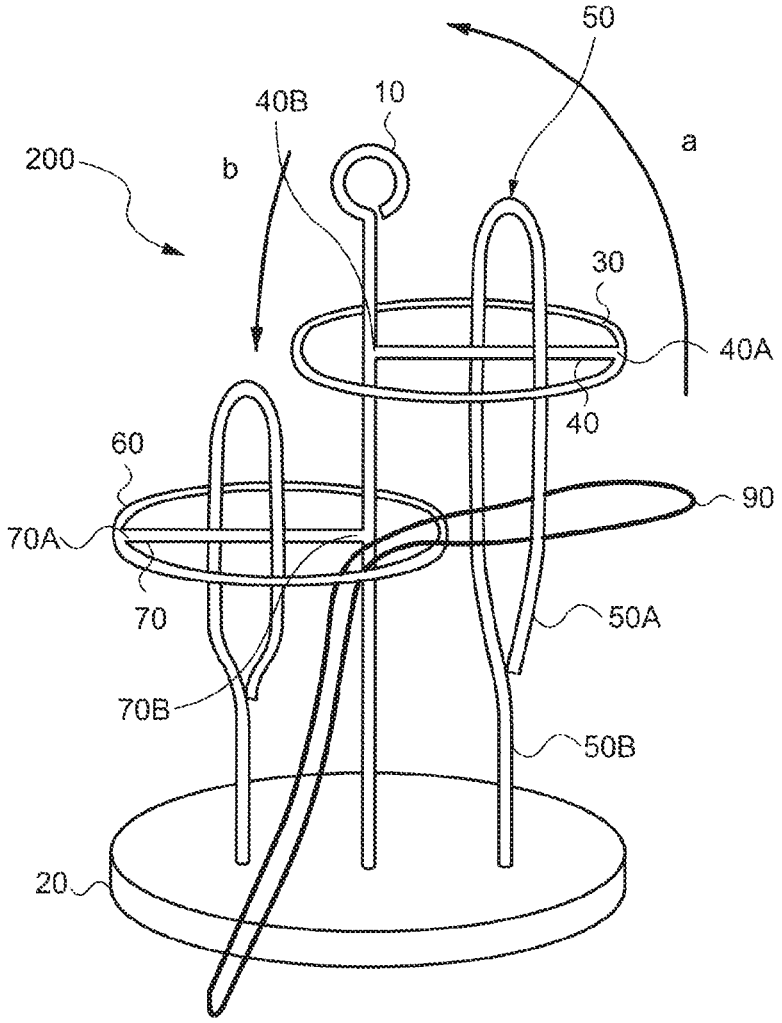
FIG. 4A is a diagram describing a first operation and a first solution of a wisdom ring puzzle 200 in the second embodiment of the present invention.
Figure 4B:
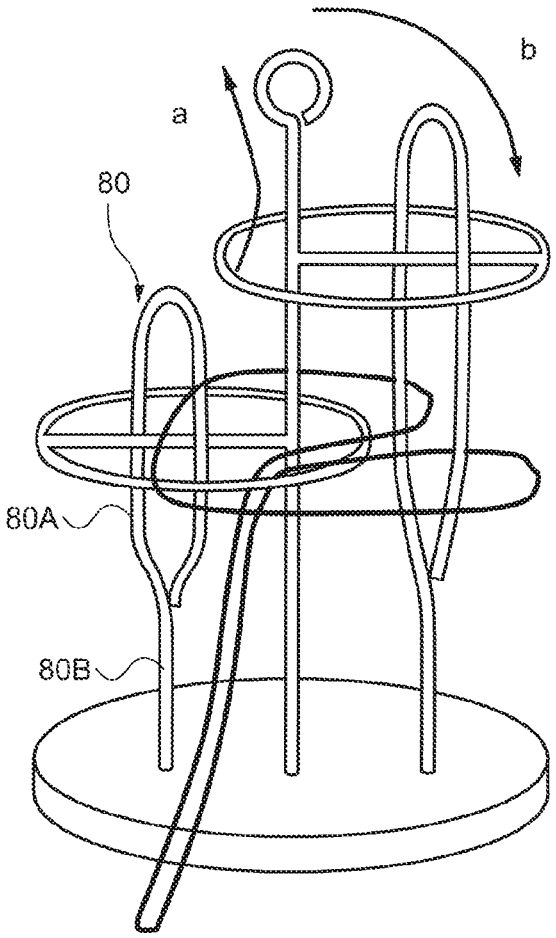
FIG. 4B is a diagram describing the first operation and the first solution of the wisdom ring puzzle 200 in the second embodiment of the present invention.

Next, as indicated by arrows a and b of FIG. 4A, the tip of the string 90 is moved from the right side of the first structure 50 and outside the first annular member 30 to go over the first annular member 30, the first structure 50, and the post 10 to come above the second annular member 60 between the post 10 and the second structure 80 to cause a state shown in FIG. 4B (step 402).

Next, as indicated by an arrow a of FIG. 4B, the tip of the string 90 is moved along the post 10 from below to above the first annular member 30 (step 403). Furthermore, as indicated by an arrow b of FIG. 4B, the tip of the string 90 is caused to go over the post 10 and the first structure 50 to be positioned on the right side of the first structure 50 (step 404).

Figure 4C:
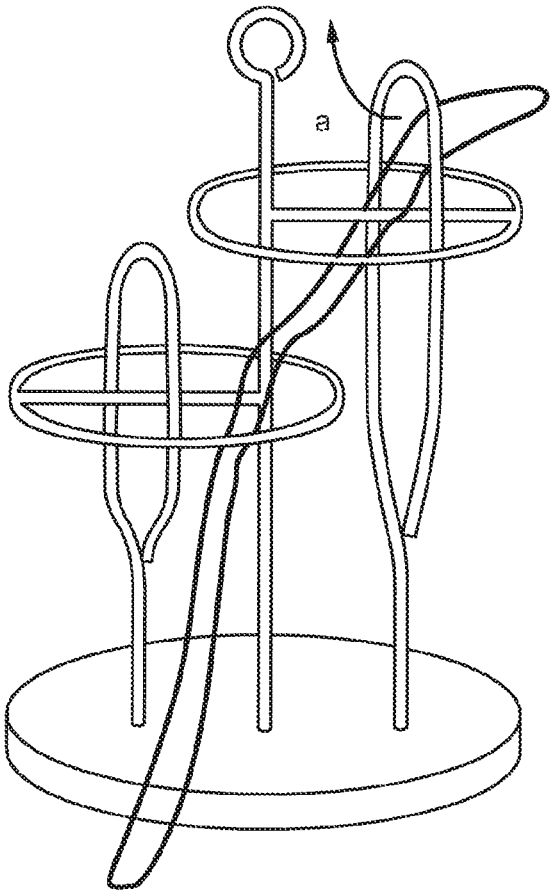
FIG. 4C is a diagram describing the first operation and the first solution of the wisdom ring puzzle 200 in the second embodiment of the present invention.

Subsequently, as indicated by an arrow a of FIG. 4C, the tip of the string 90 is moved to pass through the inside of the annular structure 50A to go along the first connection member 40 from the one end 40A to the other end 40B to be positioned between the post 10 and the first structure 50 (step 405).

Furthermore, as indicated by an arrow a of FIG. 4D, from the state of being positioned between the post 10 and the first structure 50, the tip of the string 90 is moved to go over the post 10 to go along the post 10 from above to below the first annular member 30 (step 406). By the operations so far, the tip of the string 90 is entwined at a portion where a portion above the other end 70B of the second connection member 70 and the post 10 cross.

Figure 4D:
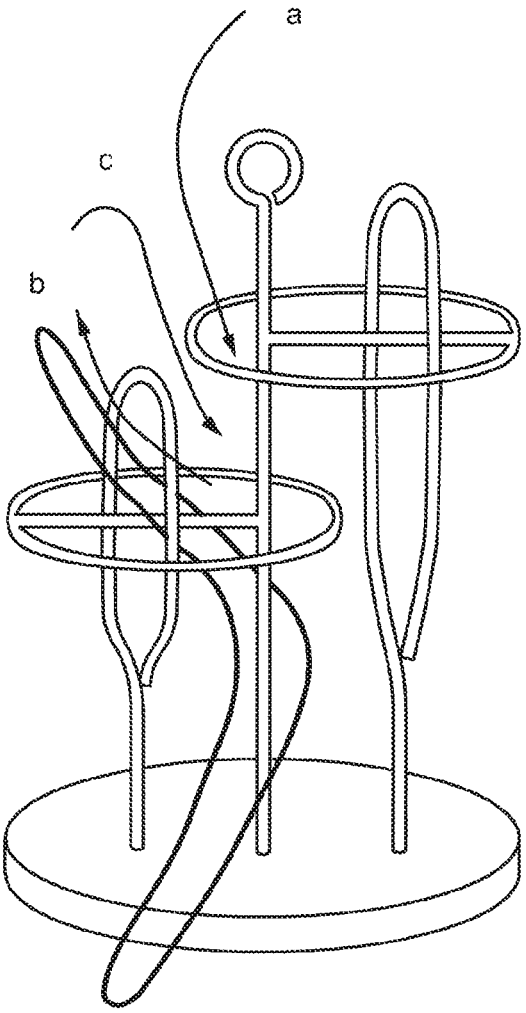
FIG. 4D is a diagram describing the first operation and the first solution of the wisdom ring puzzle 200 in the second embodiment of the present invention.
Figure 4E:
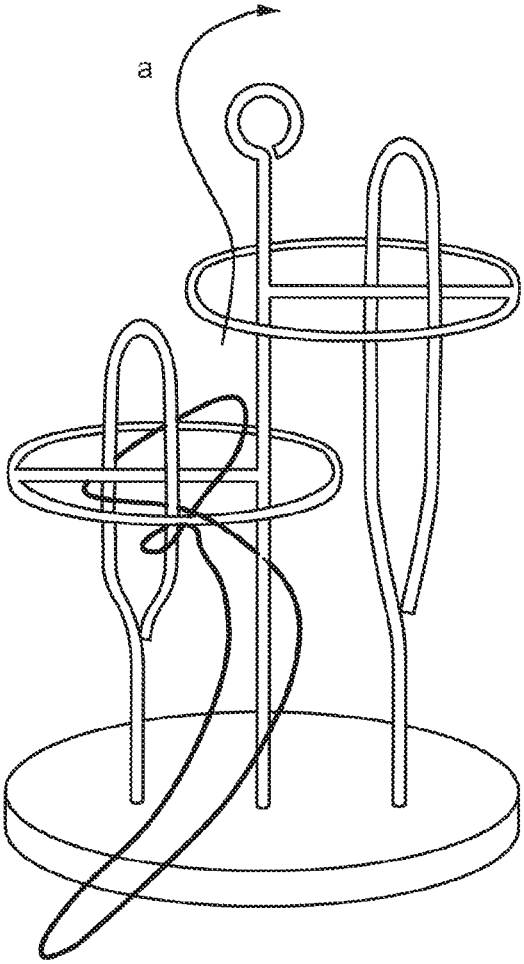
FIG. 4E is a diagram describing the first operation and the first solution of the wisdom ring puzzle 200 in the second embodiment of the present invention.

Next, as indicated by an arrow b of FIG. 4D, the tip of the string 90 is moved to pass through the inside of the annular structure 80A to go along the second connection member 70 from the other end 70B to the one end 70A. Furthermore, as indicated by an arrow c of FIG. 4D, the tip of the string 90 is moved to go over the second structure 80 from the left side of the second structure 80. Then, as shown in FIG. 4E, the tip of the string 90 is positioned between the post 10 and the second structure 80 and above the other end 70B of the second connection member 70 (step 407).

Figure 4F:
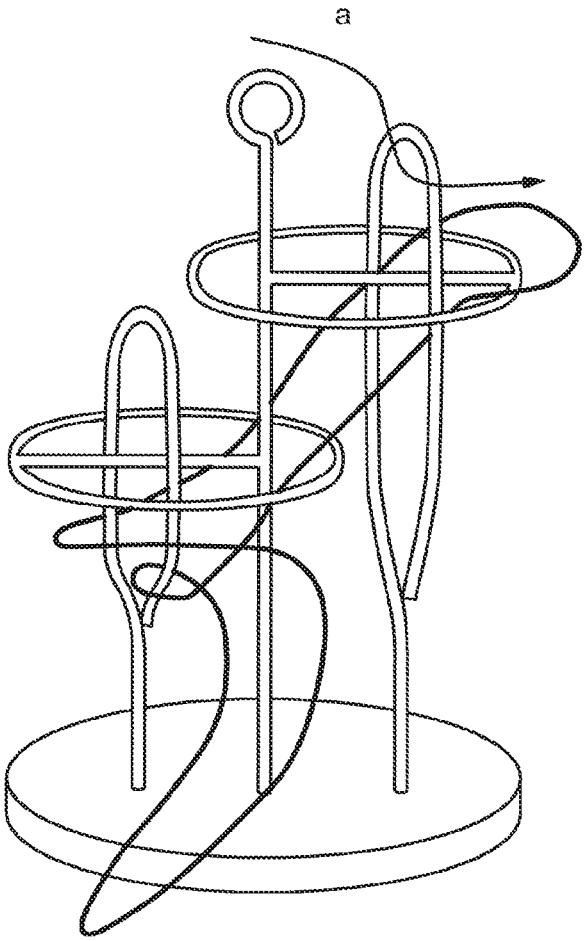
FIG. 4F is a diagram describing the first operation and the first solution of the wisdom ring puzzle 200 in the second embodiment of the present invention.

Next, as indicated by an arrow a of FIG. 4E, the tip of the string 90 is moved along the post 10 from below to above the first annular member 30 (step 408). Furthermore, as indicated by an arrow a of FIG. 4F, the tip of the string 90 is moved to go over the post 10 and pass through the inside of the annular structure 50A along the first connection member 40 from the other end 40B to the one end 40A. Then, the tip of the string 90 is positioned on the right side of the first structure 50 as shown in FIG. 4F (step 409).

Figure 4G:
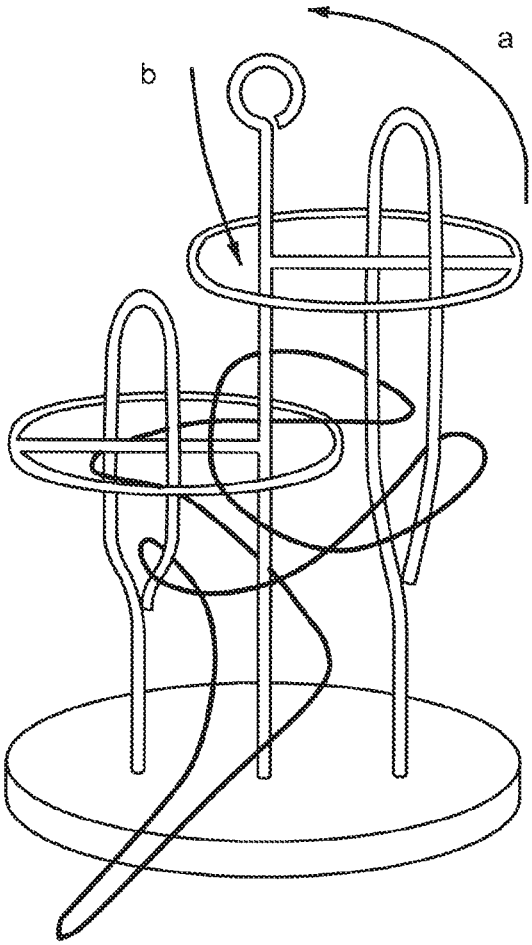
FIG. 4G is a diagram describing the first operation and the first solution of the wisdom ring puzzle 200 in the second embodiment of the present invention.

Next, as indicated by arrows a and b of FIG. 4G, the tip of the string 90 is moved from the right side of the first structure 50 to go over the first structure 50 and the post 10 and then go between the post 10 and the first annular member 30 from above to below. Then, the tip of the string 90 is positioned on the left side of the post 10 (step 410). The state shown in FIG. 4G is also a state in which the tip of the string 90 is positioned between the second structure 80 and the post 10 and above the other end 70B of the second connection member 70.

Figure 4H:
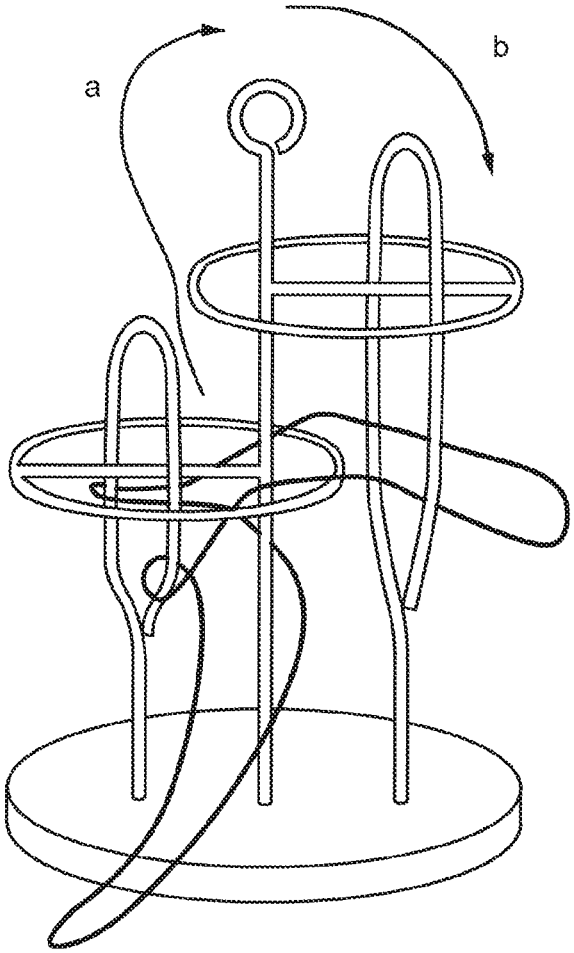
FIG. 4H is a diagram describing the first operation and the first solution of the wisdom ring puzzle 200 in the second embodiment of the present invention.
Figure 4I:
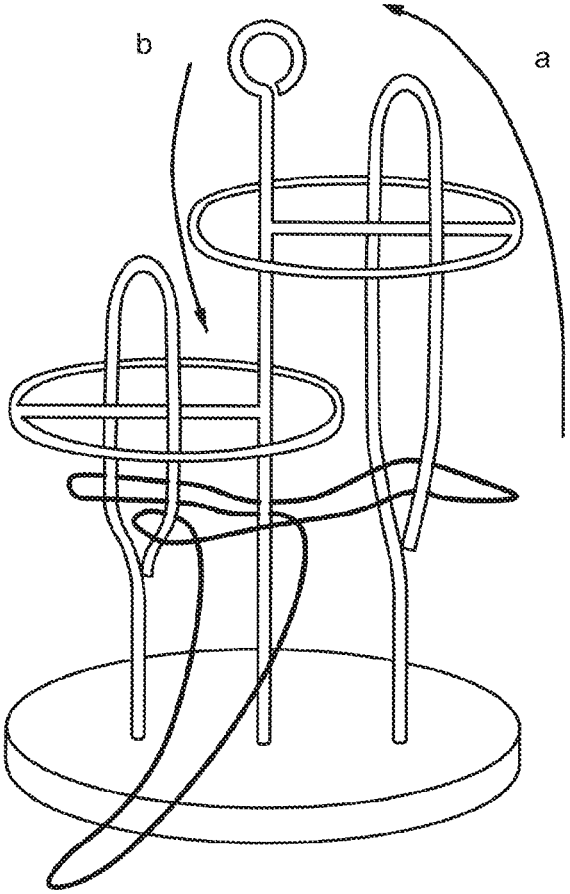
FIG. 4I is a diagram describing the first operation and the first solution of the wisdom ring puzzle 200 in the second embodiment of the present invention.

Furthermore, as indicated by arrows a and b of FIG. 4H, from the state of being positioned above the other end 70B of the second connection member 70, the tip of the string 90 is moved to go over the post 10 and the first structure 50. Then, the tip of the string 90 is positioned in the right-side space of the first structure 50 (step 411). Here, by pulling the other end opposite to the tip of the string 90 (a portion on the left side of the string 90 entwined at the second structure 80), the tip of the string 90 is pulled to a position near the post 10 (step 412).

Subsequently, the tip of the string 90 passes through the second annular member 60 from above to below. Then, the tip of the string 90 passes below the first connection member 40 and below the annular structure 50A of the first structure 50 to become in a state shown in FIG. 4I (step 413). Furthermore, as indicated by arrows a and b of FIG. 4I, the tip of the string 90 is caused to go over the outside of the first annular member 30, the first structure 50, and the post 10 to be moved at a position shown in FIG. 5A (step 414). The state shown in FIG. 5A is also a state in which the tip of the string 90 is positioned between the second structure 80 and the post 10 and above the second connection member 70.

Figure 5A:
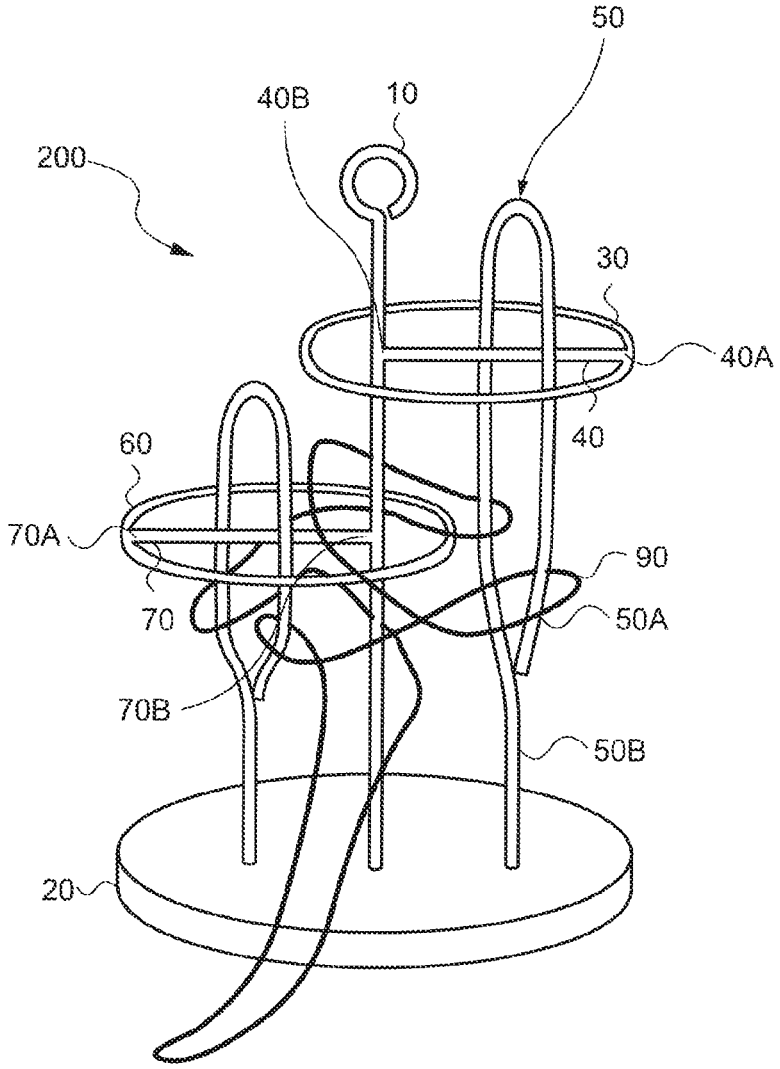
FIG. 5A is a diagram describing the first operation and the first solution of the wisdom ring puzzle 200 in the second embodiment of the present invention.
Figure 5B:
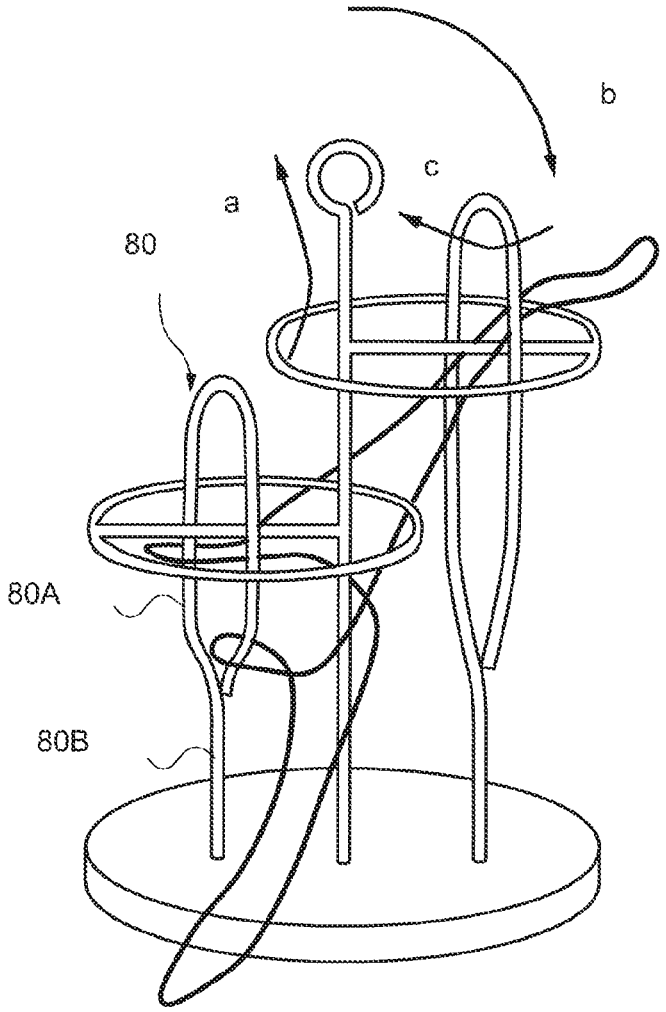
FIG. 5B is a diagram describing the first operation and the first solution of the wisdom ring puzzle 200 in the second embodiment of the present invention.

Next, from the state shown in FIG. 5A, as shown in FIG. 5B, the tip of the string 90 is caused to be positioned on the right side of the first structure 50. Specifically, as indicated by arrows a and b of FIG. 5B, the tip of the string 90 passes through the first annular member 30 along the post 10 from below to above. Then, the tip of the string 90 is caused to go over the post 10 and the first structure 50 to be positioned on the right side of the first structure 50 (step 415). Furthermore, as indicated by an arrow c of FIG. 5B, the tip of the string 90 is moved to pass through the inside of the annular structure 50A and go along the first connection member 40 from the one end 40A to the other end 40B. Then, the tip of the string 90 is caused to be positioned between the post 10 and the first structure 50 (step 416).

Next, as indicated by arrows a and b of FIG. 5C, from the state of being positioned between the post 10 and the first structure 50, the tip of the string 90 is moved to go over the post 10 to go along the post 10 from above to below the first annular member 30 (step 417). By the operations so far, the tip of the string 90 is entwined at a portion where a portion above the other end 70B of the second connection member 70 and the post 10 cross.

Figure 5C:
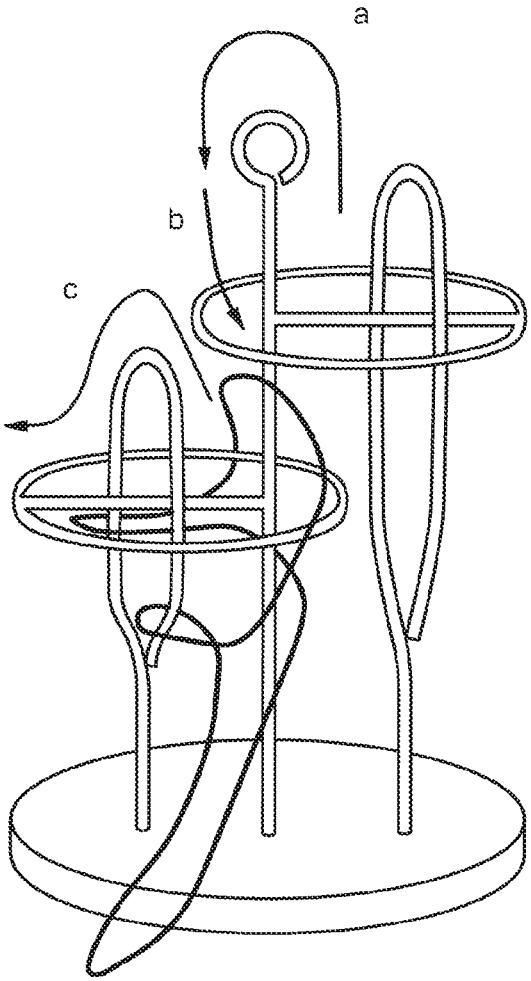
FIG. 5C is a diagram describing the first operation and the first solution of the wisdom ring puzzle 200 in the second embodiment of the present invention.
Figure 5D:
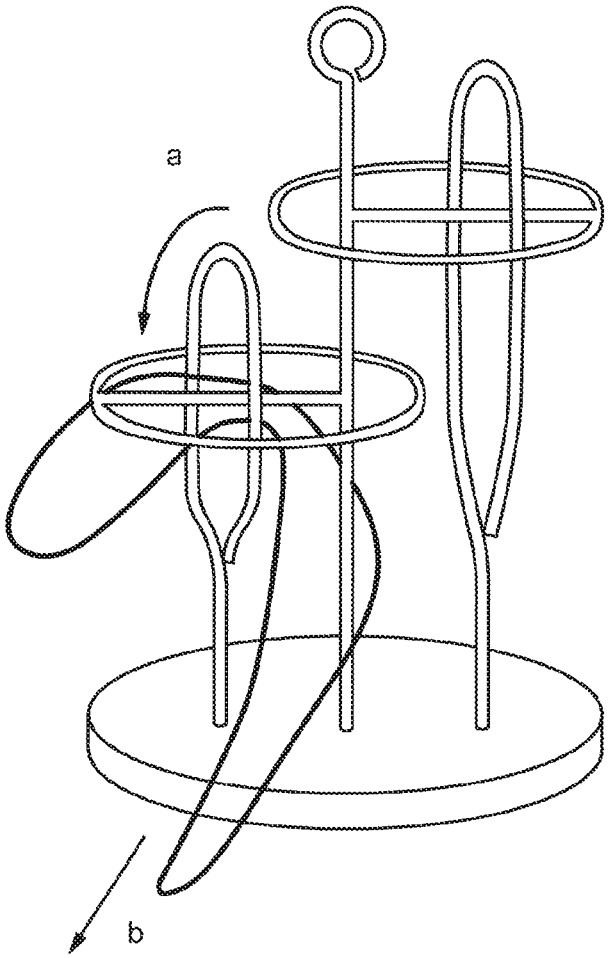
FIG. 5D is a diagram describing the first operation and the first solution of the wisdom ring puzzle 200 in the second embodiment of the present invention.

Next, as indicated by an arrow c of FIG. 5C, the tip of the string 90 is caused to go over the second structure 80 to be positioned on the left side of the second structure 80 as shown in FIG. 5D (step 418).

Lastly, as indicated by an arrow b of FIG. 5D, by pulling the tip of the string 90 the end opposite to the tip of the string 90, the tip of the string 90 passes below the annular structure 50A. Then, the tip of the string 90 is entwined at the bottom of the post 10 (step 419).

2-3. First Solution of Wisdom Ring Puzzle 200

A first solution of the wisdom ring puzzle 200 in the second embodiment of the present invention is described.

In the first solution, the operations from step 401 to step 419 described by using FIG. 4A to FIG. 4I and FIG. 5A to FIG. 5D are performed in reverse from step 419 to step 401, thereby allowing the string entwined at the bottom of the post 10 to be removed from the post 10. In the following, a brief description is given.

The tip of the string 90 passes below the second connection member 70 and below the annular structure 80A of the second structure 80 outward from a side where the post 10 is arranged. Then, the tip of the string 90 is moved to the outer space on the left side of the second structure 80. Next, the tip of the string 90 is caused to go over the outside of the second annular member 60 and the second structure 80 to be moved above the other end 70B of the second connection member 70 between the second structure 80 and the post 10.

Furthermore, the tip of the string 90 is moved along the post 10 from below to above the first annular member 30 to go over the post 10. Subsequently, the tip of the string 90 is moved to pass through the inside of the annular structure 50A to go along the first connection member 40 from the other end 40B to the one end 40A. Then, the tip of the string 90 is moved to the outside space on the right side of the first structure 50. Next, the tip of the string 90 is caused to go over the first structure 50 and the post 10 from the right side of the first structure 50. Furthermore, the tip of the string 90 is moved from above to below between the post 10 and the first annular member 30. Then, the tip of the string 90 is moved between the second structure 80 and the post 10.

Still further, from the state of being positioned above the other end 70B of the second connection member 70, the tip of the string 90 is moved from the left side of the second structure 80 and outside the second annular member 60 to go over the post 10 and the first structure 50. Then, the tip of the string 90 is moved to the right-side space of the first structure 50. Here, by pulling the other end opposite to the tip of the string 90, the tip of the string 90 is pulled to a position near the post 10. Subsequently, the tip of the string 90 passes through the second annular member 60 from below to above. Subsequently, the tip of the string 90 passes below the first connection member 40 and below the annular structure 50A of the first structure 50. Here, the tip of the string 90 is moved to the right-side space of the annular structure 50A again. Furthermore, the tip of the string 90 is caused to go over the outside of the first annular member 30, the first structure 50, and the post 10 to be moved between the second structure 80 and the post 10 (above the other end 70B of the second connection member 70).

The tip of the string 90 passes through the first annular member 30 from below to above along the post 10. Subsequently, the tip of the string 90 is caused to go over the post 10 and the first structure 50 to be moved to the right side of the first structure 50. Furthermore, the tip of the string 90 is moved to go through the inside of the annular structure 50A to go along the first connection member 40 from the one end 40A to the other end 40B. Subsequently, the tip of the string 90 is caused to go over the post 10 and to be moved along the post 10 from above to below the first annular member 30. Here, the string 90 is away from the first annular member 30. Subsequently, the tip of the string 90 is caused to go over the second structure 80 to be moved to the left side of the second structure 80. Furthermore, the tip of the string 90 is moved inside the annular structure 80A of the second structure 80 to go along the second connection member 70 from the one end 70A toward the other end 70B. By the operations so far, the tip of the string 90 is entwined at a portion where a portion above the other end 70B of the second connection member 70 and the post 10 cross.

Next, the tip of the string 90 is moved along the post 10 from below to above the first annular member 30. Then, the tip of the string 90 is caused to go over the post 10 to be moved to pass through the inside of the first structure 50 to go from the other end 40B to the one end 40A of the first connection member 40. In this manner, the tip of the string 90 is moved to the right-side space on the right side of the first structure 50. Furthermore, the tip of the string 90 is caused to go over the first structure 50 and the post 10 to be moved between the first annular member 30 and the post 10 from above to below.

Lastly, the tip of the string 90 passes between the second structure 80 and the first annular member 30 to go over the outside of the first annular member 30, the post 10, and the first structure 50 to be moved to the right-side space of the first structure 50. Then, by pulling the end opposite to the tip of the string 90, the tip of the string 90 can be removed from each member provided to the base 20.

2-4. Second Operation of Wisdom Ring Puzzle 200

A second operation of the wisdom ring puzzle 200 in the second embodiment of the present invention is described by using FIG. 6A to FIG. 6I. Description of a structure identical or similar to that of FIG. 1A, FIG. 2A to FIG. 2E, FIG. 3A to FIG. 3D, FIG. 4A to FIG. 4I, and FIG. 5A to FIG. 5D may be omitted.

Figure 6A:
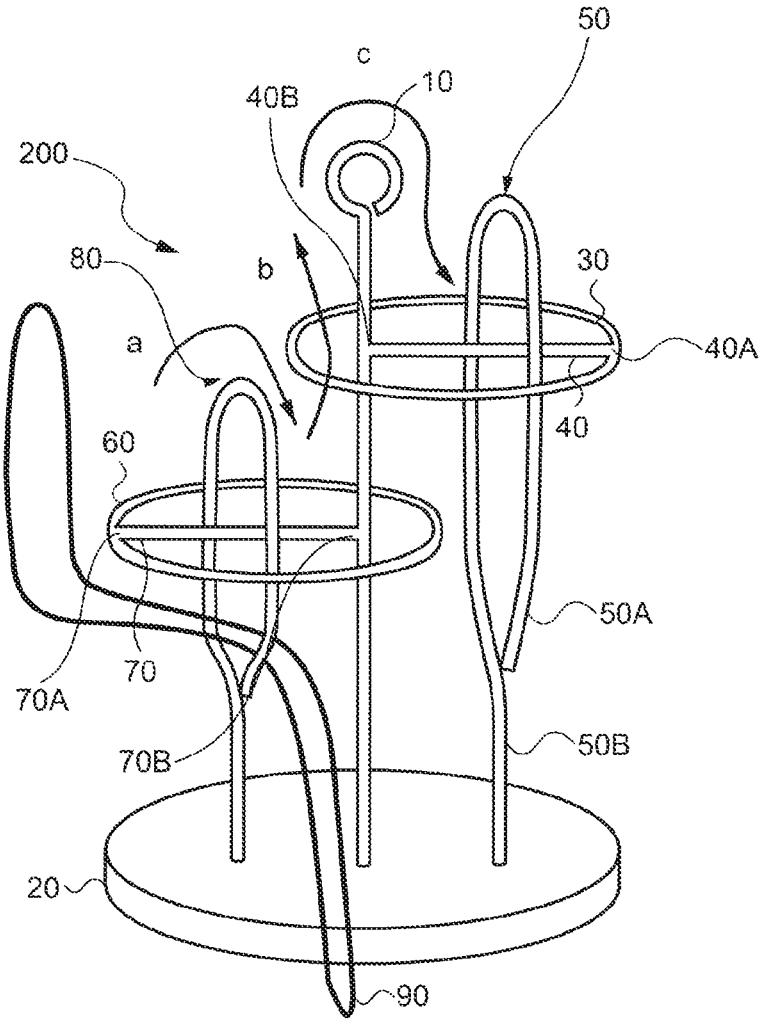
FIG. 6A is a diagram describing a second operation and a second solution of the wisdom ring puzzle 200 in the second embodiment of the present invention.

First, from the state in which the string 90 is removed from each member provided to the base 20, as shown in FIG. 6A, the tip of the string 90 passes between the post 10 and the second structure 80 to go below the second connection member 70 and the lower side of the annular structure 80A of the second structure 80 to be moved to the left side of the second structure 80 (step 501).

Figure 6B:
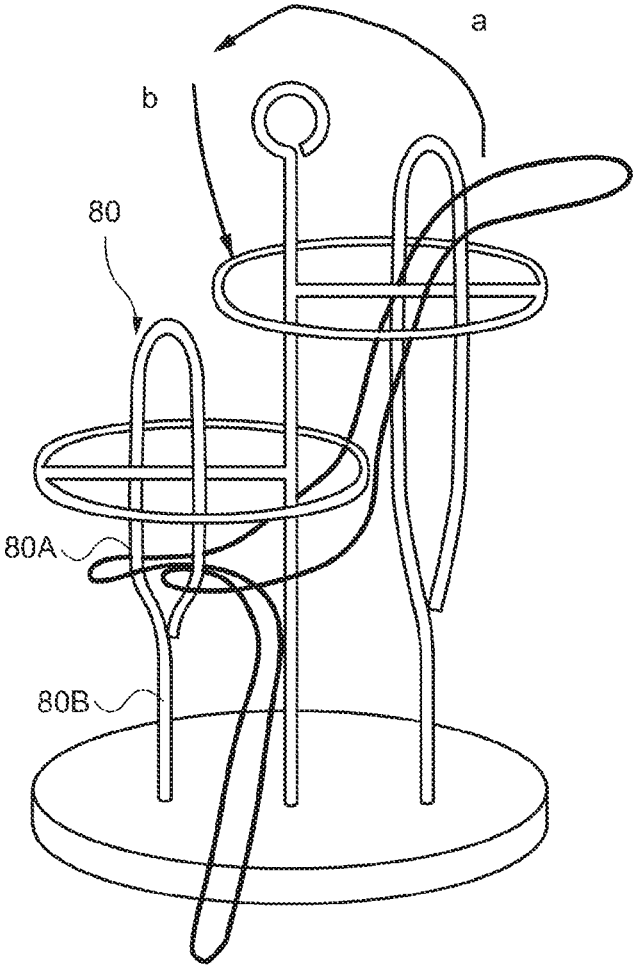
FIG. 6B is a diagram describing the second operation and the second solution of the wisdom ring puzzle 200 in the second embodiment of the present invention.
Figure 6C:
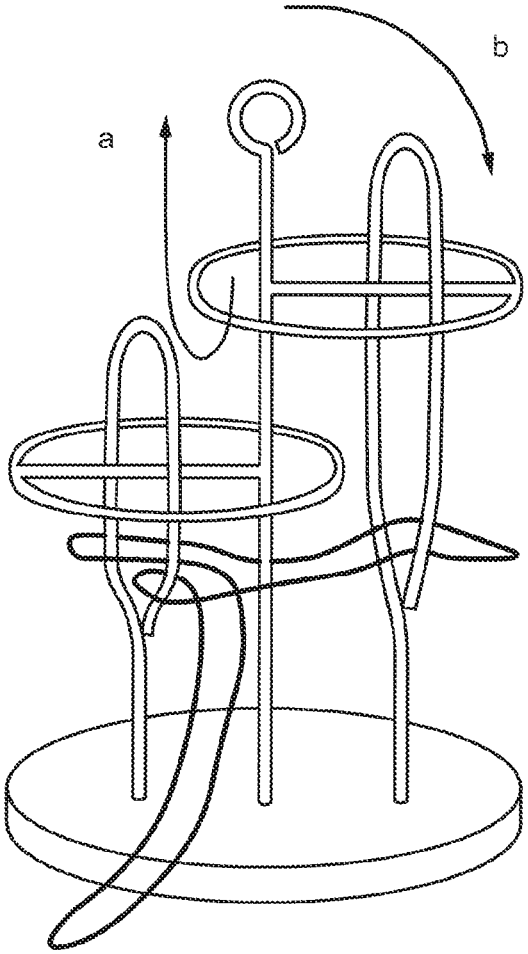
FIG. 6C is a diagram describing the second operation and the second solution of the wisdom ring puzzle 200 in the second embodiment of the present invention.
Figure 6D:
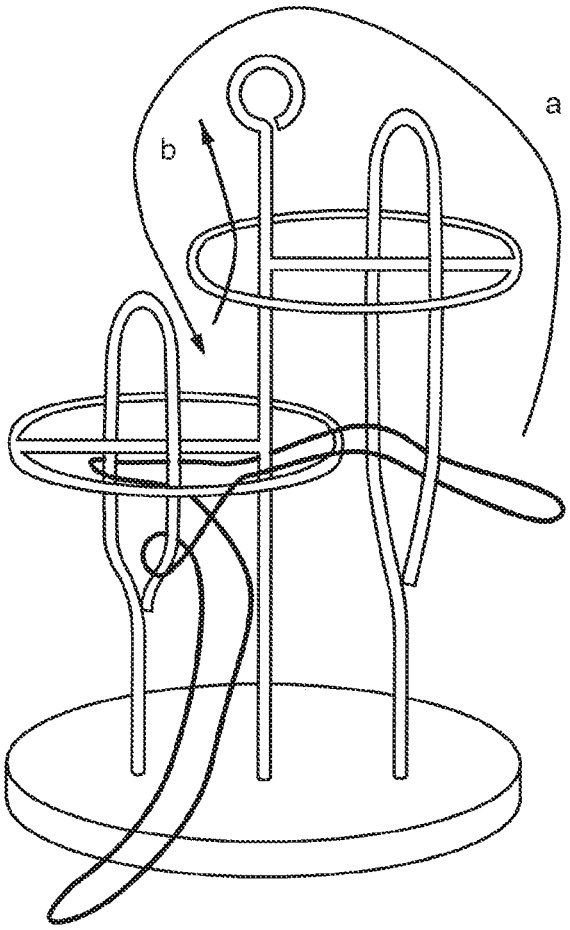
FIG. 6D is a diagram describing the second operation and the second solution of the wisdom ring puzzle 200 in the second embodiment of the present invention.
Figure 6E:
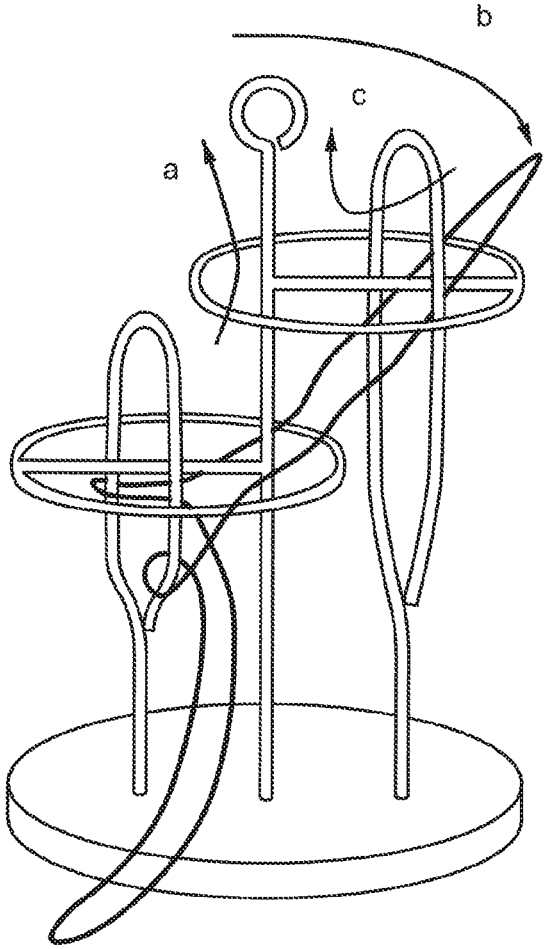
FIG. 6E is a diagram describing the second operation and the second solution of the wisdom ring puzzle 200 in the second embodiment of the present invention.

Subsequently, operations indicated by arrows a, b, and c of FIG. 6A, arrows a and b of FIG. 6B, and arrows a and b of FIG. 6C are performed. Since the operations indicated by the arrows a, b, and c of FIG. 6A, the arrows a and b of FIG. 6B, and the arrows a and b of FIG. 6C are similar to those indicated by the arrow c of FIG. 4D, the arrow a of FIG. 4E, the arrow a of FIG. 4F, the arrows a and b of FIG. 4G, and the arrows a and b of FIG. 4H (step 407, step 408, step 409, step 410, step 411, and step 412), description is omitted herein.

Figure 6F:
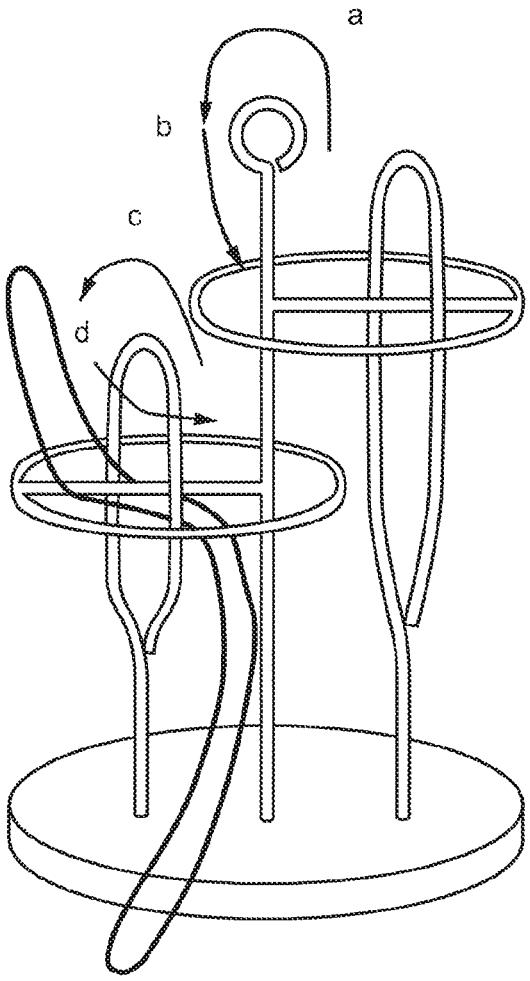
FIG. 6F is a diagram describing the second operation and the second solution of the wisdom ring puzzle 200 in the second embodiment of the present invention.

Next, the tip of the string 90 passes from below to above the second annular member 60. Then, the tip of the string 90 passes below the first connection member 40 through the lower side of the annular structure 50A of the first structure 50 to become a state shown in FIG. 6D (step 513). Furthermore, operations indicated by arrows a and b of FIG. 6D, arrows a, b, and c of FIG. 6E, and arrows a, b, and c of FIG. 6F are performed. Since the operations indicated by the arrows a and b of FIG. 6D, the arrows a, b, and c of FIG. 6E, and the arrows a and b of FIG. 6F are similar to those indicated by the arrows a and b of FIG. 4I, the arrows a, b, and c of FIG. 5A and FIG. 5B, and the arrows a and b of FIG. 5C (step 414, step 415, step 416, and step 417), description is omitted herein.

Subsequently, as indicated by an arrow c of FIG. 6F, tip of the string 90 is moved to a position after going over the second structure 80 (step 518). Furthermore, by pulling the other end of the string 90 opposite to the tip of the string 90 in a direction indicated by an arrow d of FIG. 6F, the tip of the string 90 is entwined at the second connection member 70 (step 519).

Figure 6G:
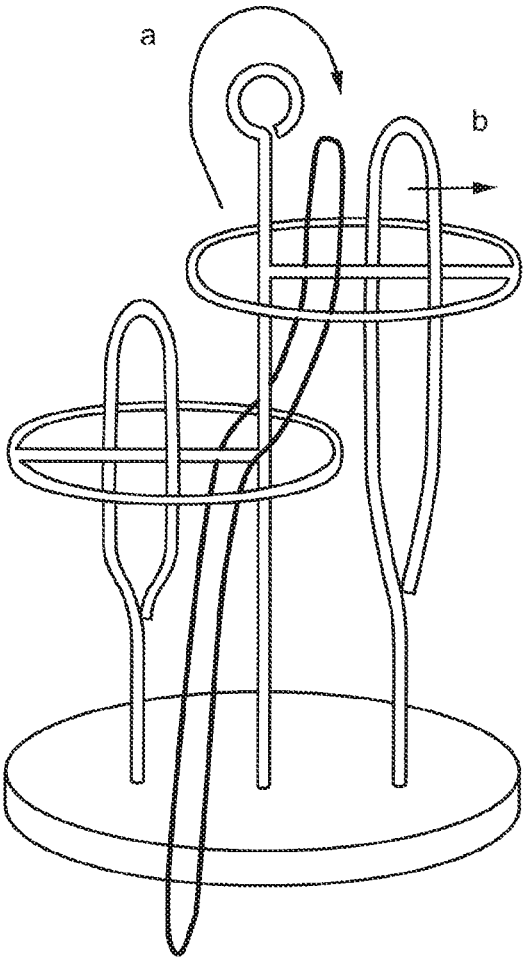
FIG. 6G is a diagram describing the second operation and the second solution of the wisdom ring puzzle 200 in the second embodiment of the present invention.
Figure 6H:
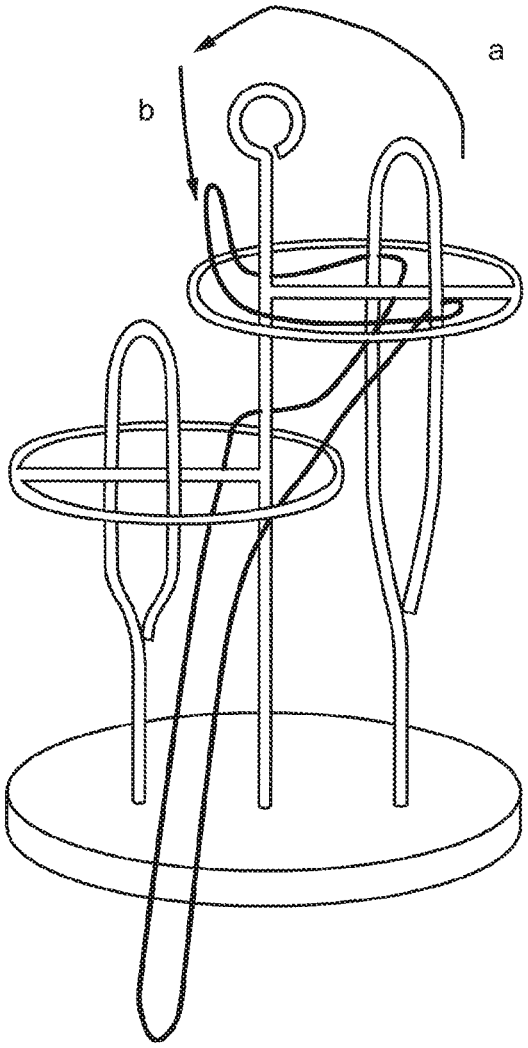
FIG. 6H is a diagram describing the second operation and the second solution of the wisdom ring puzzle 200 in the second embodiment of the present invention.
Figure 6I:
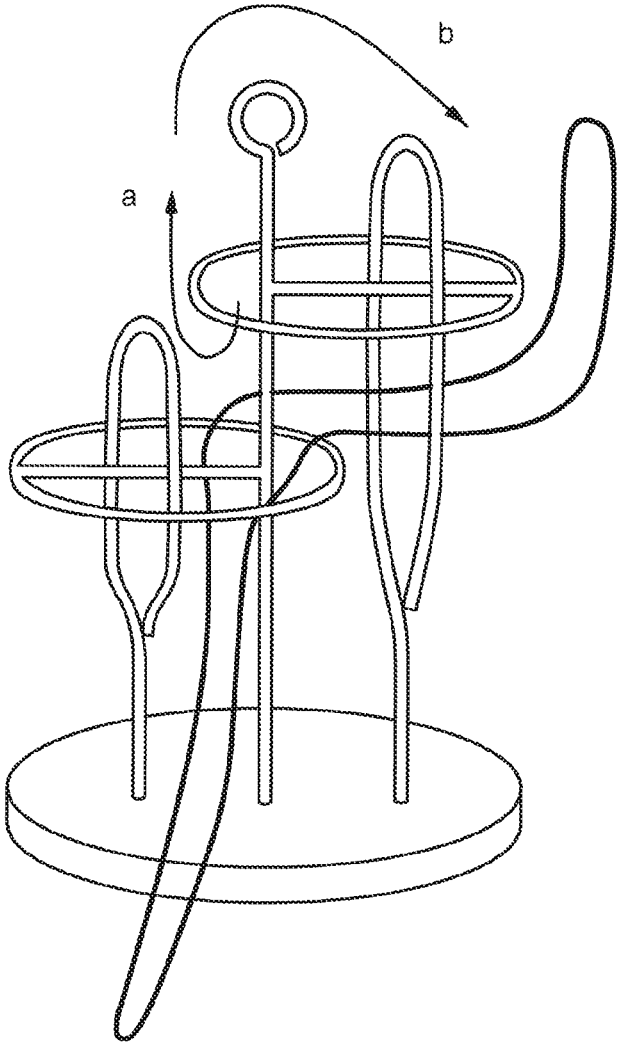
FIG. 6I is a diagram describing the second operation and the second solution of the wisdom ring puzzle 200 in the second embodiment of the present invention.

Subsequently, operations indicated by arrows a and b of FIG. 6G, arrows a and b of FIG. 6H, and arrows a and b of FIG. 6I are performed. Since the operations indicated by the arrows a and b of FIG. 6G, the arrows a and b of FIG. 6H, and the arrows a and b of FIG. 6I are similar to those indicated by the arrow a of FIG. 4E, the arrow a of FIG. 4F, the arrows a and b of FIG. 4G, and the arrows a and b of FIG. 4H (step 408, step 409, step 410, step 411, and step 412), description is omitted herein.

Lastly, the end of the string 90 opposite to the tip of the string 90 positioned in the right-side space of the first structure 50 is pulled. Then, the tip of the string 90 passes through a lower portion of the annular structure 50A to be entwined at the bottom of the post 10 (step 520).

2-5. Second Solution of Wisdom Ring Puzzle 200

A second solution of the wisdom ring puzzle 200 in the second embodiment of the present invention is described.

In the second solution, the operations described by using FIG. 6A to FIG. 6I are performed in reverse, thereby allowing the string entwined at the bottom of the post 10 to be removed from the post 10. In the following, a brief description is given.

The tip of the string 90 passes through the second annular member 60 from below to above. Furthermore, the tip of the string 90 passes below the first connection member 40 and the lower side of the annular structure 50A of the first structure 50 from the left side to the right of the first structure 50. Subsequently, the tip of the string 90 is caused to go over the outside of the first annular member 30, the first structure 50, and the post 10 to be moved between the second structure 80 and the post 10.

Furthermore, the tip of the string 90 is moved along the post 10 from below to above the first annular member 30 to be moved to the outer space on the right side of the post 10 and the first structure 50. Furthermore, the tip of the string 90 passes through the inside of the annular structure 50A to be moved along the first connection member 40 from the one end 40A to the other end 40B. Subsequently, the tip of the string 90 is caused to go over the post 10. Furthermore, the tip of the string 90 is moved between the post 10 and the first annular member 30 from above to below. Subsequently, the tip of the string 90 is moved between the second structure 80 and the post 10. Here, the tip of the string 90 is entwined at the second connection member 70.

Subsequently, the tip of the string 90 is moved inside the annular structure 80A of the second structure 80 to go along the second connection member 70 from the other end 70B toward the one end 70A. Furthermore, the tip of the string 90 is caused to go over the second structure 80 to be moved to a space between the second structure 80 and the annular member 30. Furthermore, the tip of the string 90 is moved along the post 10 from below to above the first annular member 30. Next, the tip of the string 90 is caused to go over the post 10, pass through the inside of the annular structure 50A, and go along the first connection member 40 from the other end 40B to the one end 40A. Then, the tip of the string 90 is moved to the outer space on the right side of the first structure 50. Next, the tip of the string 90 is caused to go over the first structure 50 and the post 10 to be moved along the post 10 from above to below the first annular member 30. Here, the string 90 is away from the first annular member 30.

Furthermore, the tip of the string 90 is caused to go over the outside of the first annular member 30, the post 10, and the first structure 50 to be moved to the right side of the first structure 50. Here, by pulling the string 90 entwined at the second structure 80, the tip of the string 90 is moved to the post 10. Subsequently, the tip of the string 90 passes from above to below the second annular member 60, and passes below the first connection member 40 and the lower side of the annular structure 50A of the first structure 50 from the left side to the right side of the first structure 50.

Subsequently, the tip of the string 90 is caused to go over the outside of the first annular member 30, the first structure 50, and the post 10 to be moved between the second structure 80 and the post 10. Next, the tip of the string 90 passes from below to above the first annular member 30 along the post 10, and is caused to go over the post 10 and the first structure 50 to be moved to the right side of the first structure 50. Subsequently, the tip of the string 90 passes through the inside of the annular structure 50A to be moved along the first connection member 40 from the one end 40A to the other end 40B. Subsequently, the tip of the string 90 is caused to go over the post 10 to be moved from above to below the first annular member 30 along the post 10.

Subsequently, the tip of the string 90 is moved to go over the second structure 80 from the right side of the second structure 80 to be moved to the outer space on the left side of the second structure 80. Lastly, by pulling the end of the string 90 opposite to the tip of the string 90, the string 90 can be removed from each member provided to the base 20.

2-6. Modification Example of Wisdom Ring Puzzle 200

In the specification and so forth, the example is described in which the wisdom ring puzzle 200 has two structures. However, the number of structures is not limited to this. For example, the wisdom ring puzzle 200 may have three or four or more structures. In the specification and so forth, the number of structures of the wisdom ring puzzle 200 is selected as appropriate in a range allowing the user to continuously maintain interest and enthusiasm for operations and solutions of the puzzle.

In the specification and so forth, the second annular member 60 may be swingably provided to the one end 70A of the second connection member 70. For example, the second connection member 70 is formed of a wire, and the one end 70A of the second connection member 70 is formed to have a ring shape. With the second annular member 60 surrounded by the ring-shaped portion at the one end 70A of the second connection member 70 so as not be detachable, the second annular member 60 can be swingably provided to the one end 70A of the second connection member 70.

In the specification and so forth, the example is described in which the second annular member 60 includes the post 10 and the second structure 80 inside the ring of the second annular member 60. However, the present embodiment is not limited to this. The second annular member 60 may not include the post 10 inside the ring of the second annular member 60. For example, the second annular member 60 has a chain-link ring configured of two or more connected annular members. When the second annular member 60 has a chain-link ring, of two or more connected annular members configuring the chain-link ring, the post 10 is provided inside the ring of any one of the annular members, and the second structure 80 is provided inside the ring of any one of the annular members configuring the chain-link ring positioned oppositely to the post 10 (on a second structure 80 side) with respect to the annular member including the post 10. That is, the wisdom ring puzzle 200 can include a structure having an annular member not including the post 10 inside its ring.

In the specification and so forth, the example is described in which the second connection member 70 is connected to the post 10 as passing through the inside of the second structure 80. However, the present embodiment is not limited to this. The second connection member 70 may not pass through the inside of the second structure 80. For example, the second connection member 70 does not pass through the inside of the second structure 80 but is provided on a side of the post 10 opposite to the side where the second structure 80 is provided.

In the specification and so forth, a connection member B that is different from the second connection member 70 and an annular member B that is different from the second annular member 60 may be provided. For example, the connection member B may have one end connected to the annular member B and the other end connected to the post 10, and the connection member B may not pass through the inside of the second structure 80 but may be provided so as to include the second structure 80 inside. For example, the connection member B and the annular member B are provided on a side of the post 10 opposite to the side where the second connection member 70 is provided and at a position of the post 10 higher than the height of the second connection member 70 from the base 20. Alternatively, for example, the connection member B and the annular member B are provided on a side of the post 10 opposite to the side where the second connection member 70 is provided and at a position of the post 10 lower than the height of the second connection member 70 from the base 20.

As described above, since the wisdom ring puzzle 200 in the second embodiment has a structure not in conventional disentanglement puzzles, the structure, though, that is complex compared with the wisdom ring puzzle 100, operations and solutions different from those of the conventional disentanglement puzzles are necessary, and the user can continuously maintain interest and enthusiasm for the wisdom ring puzzle.

Also, as with the wisdom ring puzzle 100, the wisdom ring puzzle 200 in the second embodiment can have any of various structures. Therefore, operations and solutions different from those of the conventional disentanglement puzzles are necessary. As a result, by using the wisdom ring puzzle in the second embodiment, the user can continuously maintain interest and enthusiasm for the wisdom ring puzzle.

According to the embodiments of the present invention, a wisdom ring puzzle capable of continuously providing interest and enthusiasm can be provided.

The embodiments described above as embodiments of the present invention can be entirely or partially implemented in combination as appropriate unless mutual inconsistency arises.

Based on the wisdom ring puzzles described as embodiments according to the present invention, those with addition, deletion, or a design change of a component performed as appropriate by a person skilled in the art or those with addition, omission, or a condition change of a step are included in the scope of the present invention as long as they have the gist of the present invention. Also, the above-described embodiments can be mutually combined in a range not causing a technical contradiction.

Also, other operations and effects that are different from the operations and effects brought by the modes of the above-described embodiments are construed as being naturally brought by the present invention as long as they are clear from the description of the specification and so forth or can be easily predicted by a person skilled in the art.

What is claimed is:

1. A wisdom ring puzzle comprising:

a base;

a three-dimensional structure including (i) a columnar structure having a first connection member and a first annular member and (ii) a first structure having an arched structure or an annular structure; and a member having an annular structure and configured separately from the three-dimensional structure, wherein the columnar structure and the first structure are provided to face each other in a side view, the first connection member passes through the first structure and has one end connected to the columnar structure and another end connected to the first annular member, and the columnar structure and the first structure are provided inside a ring of the first annular member.

2. The wisdom ring puzzle according to claim 1, further comprising:

a second structure having an arched structure or an annular structure, a second connection member, and a second annular member, wherein the columnar structure has the second connection member and the second annular member, the second connection member passes through the second structure and has one end connected to the columnar structure and another end connected to the second annular member, the columnar structure and the second structure are provided inside a ring of the second annular member, and the second connection member has a height from the base lower than a height of the first connection member from the base.

3. The wisdom ring puzzle according to claim 1, wherein the first annular member is swingably provided to the other end of the first connection member.

4. The wisdom ring puzzle according to claim 2, wherein the second annular member is swingably provided to the other end of the second connection member.

5. The wisdom ring puzzle according to claim 2, wherein the first structure is (i) a first arched structure provided by bending one member of the first structure, or (ii) a first oval structure including a first oval member; and the second structure is (i) a second arched structure provided by bending one member of the second structure, or (ii) a second oval structure including a second oval member.

* * * * *